United States Patent [19]

Deiger

[11] Patent Number: 5,000,374

[45] Date of Patent: Mar. 19, 1991

[54] CONTAINERS WITH IMPROVED CORNER STRUCTURES AND IMPROVED HEAT RETENTION PROPERTIES

[76] Inventor: Anthony J. Deiger, 2761 Riva Ridge Rd., Toledo, Ohio 43615

[21] Appl. No.: 447,788

[22] Filed: Dec. 8, 1989

Related U.S. Application Data

[63] Continuation-in-part of Ser. No. 310,108, Feb. 10, 1989, Pat. No. 4,919,326.

[51] Int. Cl.[5] ..... B65D 5/42

[52] U.S. Cl. ..... 229/109; 220/418; 220/443; 220/462; 229/120; 229/906; 229/DIG. 14

[58] Field of Search ..... 229/109, 150, 186, 169, 229/120, 906, DIG. 14, 110, 187; 426/107, 127, 128, 130, 234; 220/416, 418, 441, 443, 462

[56] References Cited

U.S. PATENT DOCUMENTS

| | | | |
|---|---|---|---|
| 285,456 | 9/1883 | Brehmer . | |
| 1,052,564 | 2/1913 | Brown . | |
| 1,767,733 | 2/1929 | Brown . | |
| 1,865,742 | 7/1932 | Chapman . | |
| 1,960,635 | 5/1934 | Kinnenon | 206/44 |
| 2,147,563 | 12/1937 | Turner | 229/35 |
| 2,646,916 | 7/1953 | Meller | 229/35 |
| 2,663,488 | 12/1953 | Gibbons | 229/36 |
| 2,784,900 | 3/1957 | Bauer | 229/35 |
| 2,819,833 | 1/1958 | Sauer | 229/41 |
| 3,067,921 | 12/1962 | Reifers | 229/2.5 |
| 3,165,253 | 1/1965 | Adams et al. | 229/33 |
| 3,273,779 | 9/1966 | Mykleby | 229/14 |
| 3,276,900 | 10/1966 | Funck | 117/93.1 |
| 3,343,744 | 9/1967 | Morell et al. | 229/27 |
| 3,344,973 | 4/1966 | Studen | 229/37 |
| 3,512,697 | 1/1969 | Robinson | 229/39 |
| 3,542,282 | 11/1970 | Troth | 229/38 |
| 3,923,234 | 12/1975 | Lund, Jr. | 229/37 |
| 3,949,931 | 4/1976 | Hall | 229/36 |
| 4,058,214 | 11/1977 | Mancuso | 206/545 |
| 4,190,757 | 2/1980 | Turpin et al. | 219/10.55 E |
| 4,237,171 | 12/1980 | Laage et al. | 426/127 |
| 4,362,265 | 12/1982 | Williams | 229/32 |
| 4,391,833 | 7/1983 | Self et al. | 426/523 |
| 4,441,626 | 4/1984 | Hall | 220/443 |
| 4,765,534 | 8/1988 | Zion et al. | 229/109 |
| 4,919,326 | 4/1990 | Deiger | 229/109 |

FOREIGN PATENT DOCUMENTS

| | | | |
|---|---|---|---|
| 21682 | 3/1935 | Australia . | |
| 1320926 | 2/1963 | France | 229/41 C |
| 2329523 | 5/1977 | France | 229/DIG. 11 |
| 2408525 | 7/1979 | France | 229/109 |
| 2018226 | 10/1979 | United Kingdom | 229/DIG. 11 |
| 2116150 | 9/1980 | United Kingdom | 229/109 |

*Primary Examiner*—Gary E. Elkins

*Attorney, Agent, or Firm*—John C. Purdue; David C. Purdue

[57] ABSTRACT

Several versions of a container incorporating a corner structure including at least one locking tab are disclosed. The corner structure comprises a top or bottom panel, a front wall connected to the top or bottom panel, a side wall connected to the top or bottom panel, a diagonal side wall panel connected to the side wall, a coupling panel connecting the diagonal side wall panel to the top or bottom panel and a reverse diagonal side wall panel connected to the front wall and the coupling panel. A first locking tab may be connected to the diagonal side wall panel opposite the side wall. The first locking tab is received between the front wall and the reverse diagonal side wall panel. A second locking tab may be connected to the first locking tab, opposite the diagonal side wall panel. The second locking tab is positionable in face-to-face relationship with the front wall. A tray embodiment includes four corner structures with locking tabs. A double side wall container embodiment is disclosed with outer corner structures including an outer coupling panel provided with a tab which can be held captive between opposed portions of the container to provide additional structural integrity. In a container with opposed corner structures provided on the bottom panel, a closure flap can be provided on the top panel. The closure flap is frictionally held between first locking tabs and the front wall or between first and second locking tabs.

33 Claims, 13 Drawing Sheets

CONTAINERS WITH IMPROVED CORNER STRUCTURES AND IMPROVED HEAT RETENTION PROPERTIES

REFERENCE TO RELATED APPLICATION

This is a continuation-in-part of application Ser. No. 310,108 filed Feb. 10, 1989, now U.S. Pat. No. 4,919,326 issued 4/24/90.

BACKGROUND OF THE INVENTION

This invention relates to containers especially suited for protecting hot food products such as freshly baked pizza pies. More specifically, the invention is concerned with such containers featuring one or more expedients for preserving the integrity and quality of a pizza pie. In one embodiment, a container is provided with a protective and insulative laminate covering substantially all of the interior surface of the bottom of the container but not covering substantially all of the interior surface of the top of the container. In another embodiment, a container is provided having interior and exterior side walls spaced apart from one another and extending around at least a portion of the periphery of the container and vents for directing air heated by the hot pizza pie between at least a portion of the interior and exterior side walls for heat transfer with the former. A self erecting embodiment of the double wall container is disclosed. The vented double wall construction may advantageously be combined with the provision of a protective laminate on the bottom of the container to provide controlled thermal insulation and prevent migration between the pizza pie and the container.

There are a number of prior art containers designed especially for pizza pies. Conventional chipboard boxes are perhaps the least effective, in that they are flimsy before a pizza pie is placed inside. When a hot pie is placed in a chipboard container, the heat and moisture quickly warp and weaken the container making it wholly inappropriate for its purpose. Several conventional styles of single wall corrugated pizza boxes are in use today. These containers stand up better to heat and moisture than the chipboard containers, but they offer little or no advantage in terms of ease of assembly. Both types of prior art containers impart, to some degree, a cardboard taste to pizza.

U.S. Pat. No. 3,512,697 discloses an octagonal container in which diagonal corner elements reinforce the top and bottom. U.S. Pat. No. 4,765,534 discloses several embodiments of an octagonal pizza container with diagonal corner forming elements. Each one of the elements is connected to the bottom of the container and one of two adjacent side walls, but is disconnected from the other adjacent side wall.

There remains a need for a pizza container which is easy to assemble around a pizza while providing new levels of protection for the quality and integrity of the pizza contained therein.

SUMMARY OF THE INVENTION

In one respect, the invention is a container for pizza pies and similar hot food products and including an integral layer of polystyrene or similarly inert material covering substantially all of the inside surface of the bottom of the container. The upper surface of the polystyrene layer is preferably channelled so that moisture released from the food product can escape without making it soggy. The polystyrene material is largely confined to the inside surface of the bottom of the container to prevent excessive condensation within the container which would adversely affect the food product.

The instant invention is also based upon the discovery of a double side walled pizza container which can be assembled from an integral prescored blank. In one embodiment, the container has a bottom, two side walls connected to and extending upwardly from the bottom, a top connected to one of said sidewalls, two sidewalls connected to and extending two opposed side walls, a rear wall and an opposed pair of set-up panels which can be manipulated to set-up the carton from an integral prescored blank. In another embodiment, channels are defined between inner and outer side walls so that hot air vented into and through the channels heats the inner wall to reduce the rate at which heat is transferred therethrough. A container with corner structures including locking tabs is disclosed, as is a tray including such corner structures. A container with corner structures including locking tabs and reverse locking tabs is also disclosed.

BRIEF DESCRIPTION OF THE DRAWINGS

In FIGS. 2, 4, 12, 17, 18, 20 and 22, dotted lines represent scored or perf-scored regions between connected elements while solid lines represent die cut regions between disconnected elements.

DETAILED DESCRIPTION OF THE INVENTION

Figure 1:
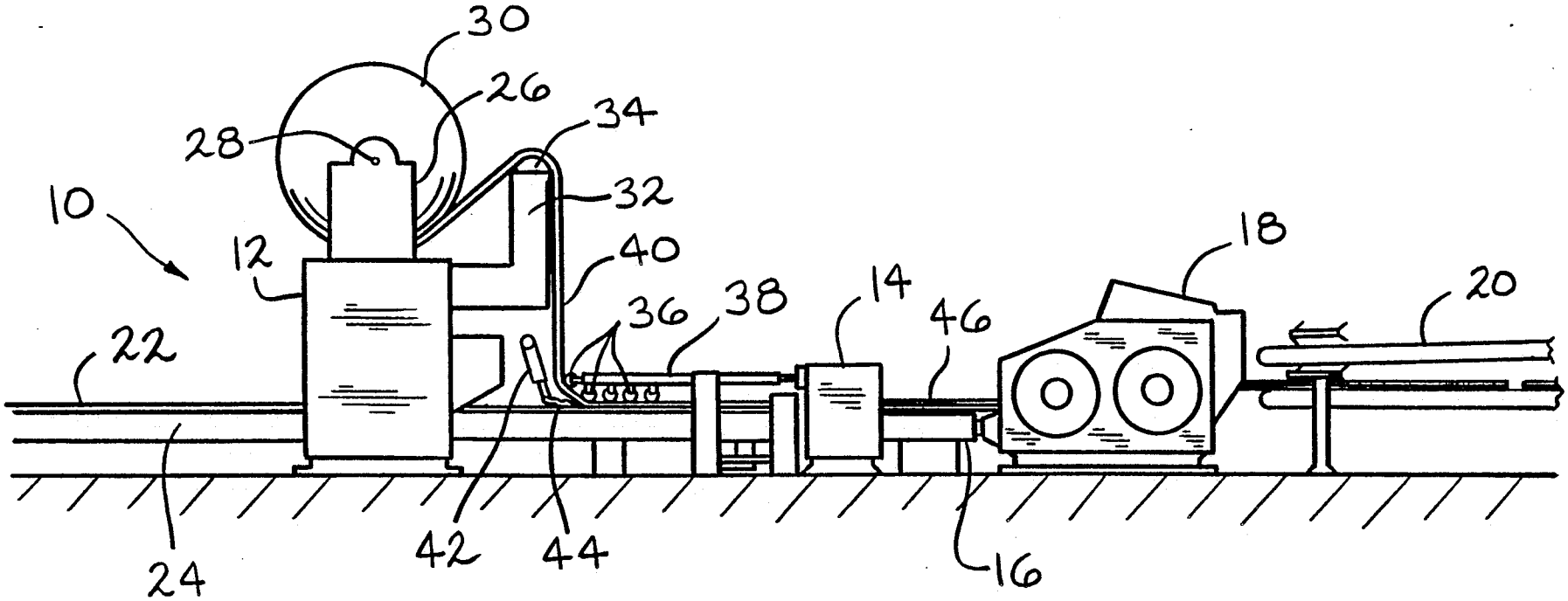
FIG. 1 is a side view of a corrugator to produce composite material comprising strips of insulative material adhered to portions of corrugated board.

A portion of a modified double face corrugating machine is indicated generally at 10 in FIG. 1. The corrugating machine 10 includes a pulley belt station 12, an automated slitter station 14, a transfer table 16, a cut-off knife 18 and a stacker 20. Corrugated material 22 moves through the corrugating machine 10 from left to right in FIG. 1 along a conveyor 24. The components of the corrugating machine 10 thus far described are conventional and can be modified in a manner described hereinbelow so that it can produce a composite corrugated material which can be die cut into a composite blank from which a container according to the present invention can be readily assembled.

A pair of bulk roll supports 26 are mounted on top of the pulley belt station 12. A shaft 28 is supported on the bulk roll supports 26 and extends across the conveyor 22. Rotatably supported on the shaft 28 are a plurality of rolls 30 of insulative cushioning material such as a foamed polystyrene or other elastomeric material. A guide bar 32 is secured to the pulley belt station 12. A roller 34 is rotatably supported on the guide bar 32. The roller 34 may include conventional means for guiding and positioning the strips of cushioning material supplied from the rolls 30 as well as means for tensioning the cushioning material as it passes over the roller 34. A plurality of pressure rollers 36 are rotatably mounted relative to a support bar 38. The pressure rollers 36 serve to apply pressure to cushioning material 40 as it passes between the pressure rollers 36 and the corrugated material 22. Together, the bulk roll supports 26, the shaft 28 and the guide bar 32 with its associated roller 34 constitute means for supplying strips of a cushioning material from a plurality of rolls 30 to be bonded to corrugated material 22 as it moves through the corrugating machine 10. These elements could be provided at a variety of positions along the corrugating machine 10. For economy of manufacture, it is desirable to bond cushioning material supplied from the rolls 30 to corrugated material 22 before it is cut and stacked.

A plurality of nozzles 42 are provided for applying a bonding agent, indicated at 44, delivered thereto by conventional equipment (not shown) to the upper surface of the corrugated material 22. The bonding agent 44 should have good adhesion properties relative to the cushioning material 40 supplied from the rolls 30 as well as to the corrugated material 22. Accordingly, as the modified corrugating machine 10 is operated and corrugated material 22 advances from left to right, bonding agent 44 is applied to selected areas on the corrugated material 22. Cushioning material from the rolls 30 is then applied to selected areas of the corrugated material 22 where the bonding agent 44 has been applied. Finally, pressure rollers 36 serve to apply downward pressure to facilitate bonding of the strips of insulative, cushioning material 40 from the rolls 30 to the corrugated material 22 to produce a composite stock material 46. The stock material comprising corrugated material with parallel, spaced apart strips of insulative, cushioning material bonded thereto, advances to the automated slitter station 14 or the automated cutter station 18 for cutting to produce a composite blank of a desired size. The rolls 30 of cushioning material can have various widths, depending on the type and style of a container to be produced from a given stock material 54. Cushioning material composed of polymeric foam are produced commercially in very wide rolls. A plurality of rolls 30 of a desired width can be cut from a roll of commercial width cushioning material and used sequentially in apparatus of the type illustrated in FIG. 1. Several embodiments of composite containers which can be produced from the composite material 46 in accordance with this invention are described below.

Figure 2:
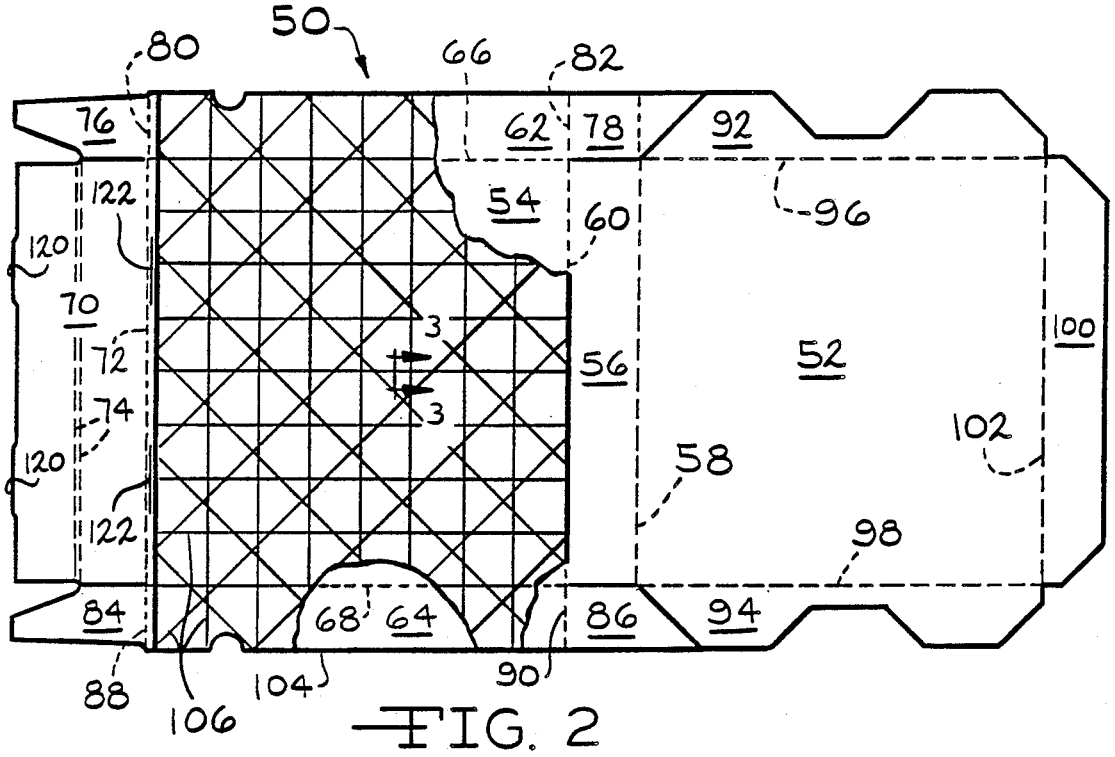
FIG. 2 is a plan view of a blank from which a container according to the present invention can be produced.

Referring to FIG. 2, there is illustrated a composite blank, indicated generally at 50, from which a container according to one embodiment of the invention can be produced. The blank 50 comprises a top panel 52, a bottom panel 54 and a rear wall 56 hingedly connecting the two panels 52 and 54 by means of fold lines 58 and 60. Opposed side walls 62 and 64 are connected to and extend outwardly from two edges of the bottom panel 54, defined by fold lines 66 and 68, respectively. A front panel 70 extends from and is connected to the front edge of the bottom panel 54, defined by a fold line 72. Double fold lines 74 are provided on the front panel 70 so that it can be folded to produce a double thick front wall. Reinforcing tabs 76 and 78 extend from opposite ends, defined by fold lines 80 and 82, of the side wall 62. Similarly, reinforcing tabs 84 and 86 extend from opposite ends, defined by fold lines 88 and 90, of the side wall 64. Side flaps 92 and 94 extend from side edges, defined by fold lines 96 and 98, respectively, of the top panel 52. A front flap 100 extends from the front edge, defined by fold line 102, of the top panel 52. This much of the blank 50 is composed, preferably, of double face corrugated material.

A layer of relatively thin insulative material 104 is adhered in face-to-face relationship with corrugated material constituting the bottom panel 54 and the side walls 62 and 64. The material 104, although broken away for illustrative purposes, extends from the free edge of the side wall 62 to the free edge of the side wall 64, and extends from the first one of the fold line 72 to the fold line 60. Thus, the blank 50 can be cut from a continuous sheet of composite material which can be produced on the modified double corrugating machine 10 (FIG. 1). The composite material would consist of a strip of the material 104, which could be supplied from the roll 30, adhered in face-to-face relationship with corrugated board. The insulative material 104 can be an extruded polystyrene which will act as a thermal insulator to keep a pizza hot and, because its integrity is unaffected by heat and moisture, it will insulate or protect the flavor of the pizza unlike the cardboard and corrugated board materials currently in use in pizza containers. Extruded polystyrene will not absorb oil or grease from a hot pizza.

As clearly shown in FIG. 2, the material 104 is adhered only to the bottom panel 54 and the two side walls 62 and 64. The other elements of the blank 50 are constituted only of corrugated board. It has been determined that, if a thermally insulative and water impervious material such as extruded polystyrene is adhered to most or all of the interior surfaces of a pizza container, when a pizza is closed up inside such a container, excessive condensation will occur inside the container to the extent that the pizza will become soggy and unpalatable. Accordingly, in a pizza container according to the present invention, insulative material is adhered to substantially all of the bottom panel and such material is not adhered to substantially all of the top panel. The side walls and the front wall and rear wall may or may not have insulative material adhered to them although, as noted above, there is a substantial manufacturing advantage attendant to bonding strips of insulative material to a portion of corrugated board, before it is cut into blanks. This eliminates the steps involved in cutting the insulative material by combining that step with the step of cutting the corrugated board. It should be appreciated that the function of the top panel 52 and the bottom panel 54 can be reversed by adhering the insulative material 104 to the top panel 52 and not to the bottom panel 54, if desired. The illustrated construction is preferred, however.

As shown in FIG. 2, the exposed surface of the insulative material 104 is patterned. Specifically, channels 106 are formed in the surface of the insulative material 104. The channels 106 constitute means for releasing steam and moist air from between the insulative material 104 and the crust of a pizza pie. Without such means, the underside of the pizza crust would become soggy and unappetizing. The particular type of channel pattern is not critical so long as it allows for the escape of moist air from between the insulative material and the underside of the pizza crust. The channels can be formed by an embossing die which could be combined with a cutting die. Alternatively, the channels could be formed in a separate step.

Figure 3:
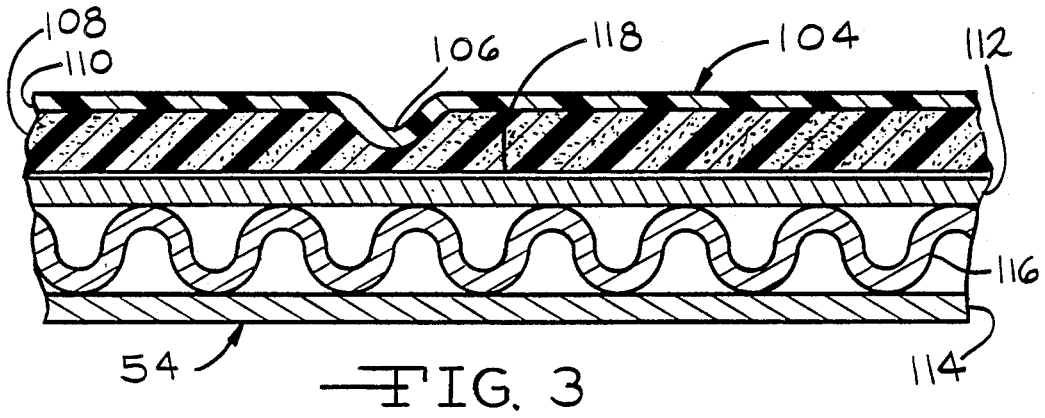
FIG. 3 is a sectional view taken along the line 3—3 of FIG. 2.

FIG. 3 illustrates a preferred type of insulative material comprising a very thin sheet of extruded polystyrene 106 with an integral skin 108 consisting of high impact polystyrene laminated to the surface of the extruded polystyrene 106. The material 104 is commercially available and is preferred for use in pizza containers for "high volume" pizza shops where seconds count. The skin 108 is so durable that a whole pizza pie can be placed on the material 104 and cut into pieces, on the skin 108, without affecting its integrity. FIG. 3 also illustrates the interface between the insulative material 104 and the corrugated board consisting of first and second liners 112 and 114 and a fluted medium 120 therebetween. An adhesive layer 118 is provided between the first liner and the layer 108 of the insulative material 104. It is contemplated, within the scope of the present invention, that a foam material may be applied to corrugated board, still hot from the corrugator and that the residual heat would act to bond the foam to the corrugated material without the need for any separate adhesive.

It will be appreciated that insulative materials other than extruded polystyrene and extruded polystyrene with a skin of high impact polystyrene. For example, other foamed polymeric materials such as polyethylene could be used. In addition, materials such as foil could be laminated to the bottom panel of a container according to the present invention. Because foil is water impervious, channel means would be needed and they could entail depressions in the corrugated material of which the bottom panel was comprised. Other insulative materials will occur to those skilled in the art and they are contemplated within the scope of the invention.

The blank 50 shown in FIG. 2 is assembled in the following manner. Side walls 62 and 64 are folded upwardly along fold lines 66 and 68. Reinforcing tabs 76 and 84 are folded along fold lines 80 and 88 towards the front panel 70 which is folded upwardly along fold line 72 and downwardly, in half, along double fold lines 74 until tabs 120 engage slots 122 and the reinforcing tabs 76 and 84 are captured within the front wall of the container. Reinforcing tabs 78 and 86 are folded along fold lines 82 and 90 towards the rear wall 56 which is then folded upwardly along fold line 60. The flaps 92, 94 and 100 of the top panel 52 are folded along fold lines 96, 98 and 102, respectively and the top panel 52 is folded downwardly along fold line 58 to close the container and capture the reinforcing tabs 78 and 86 between the rear wall 56 and the flaps 92 and 94, respectively.

Figure 4:
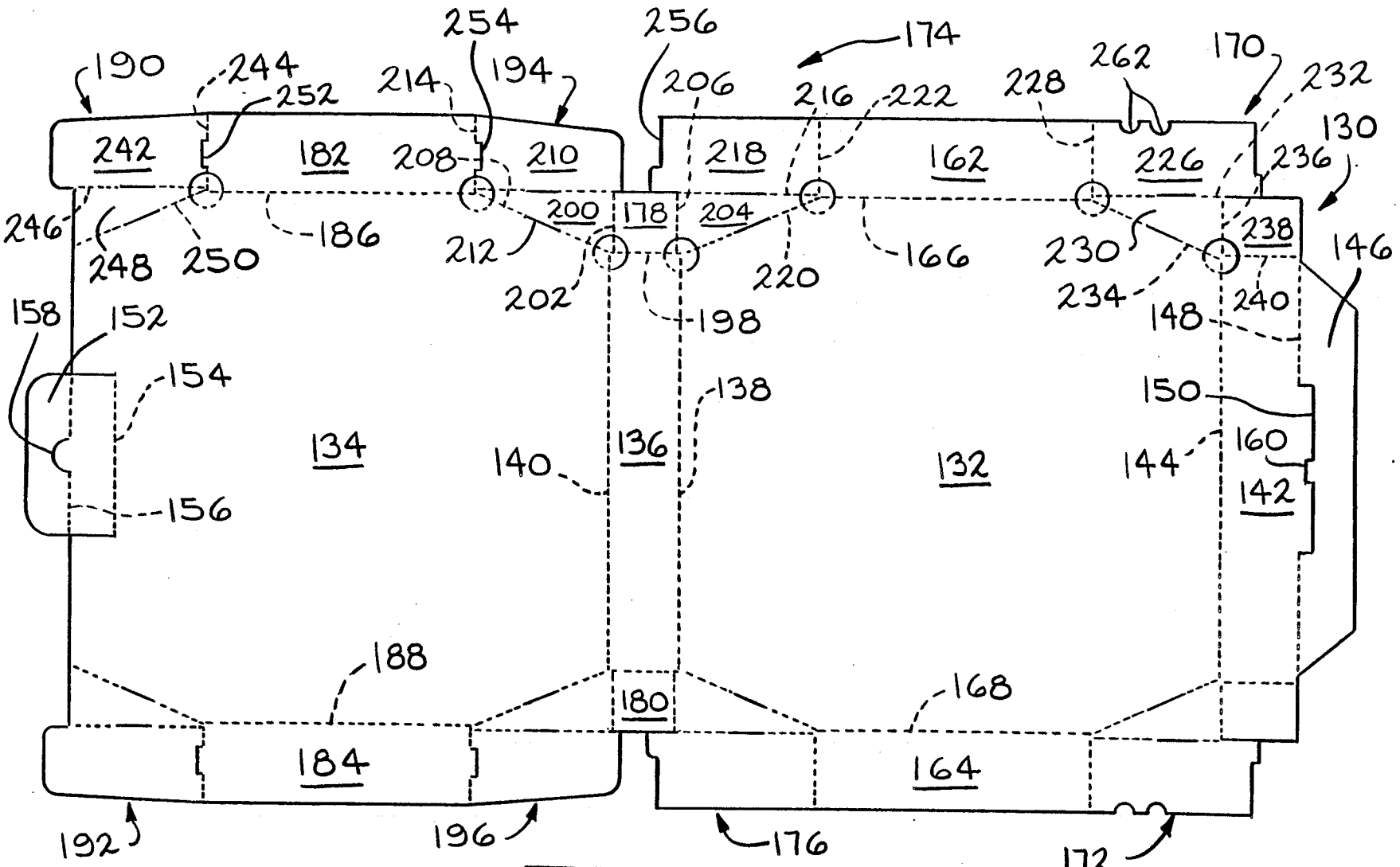
FIG. 4 is a plan view, drawn to scale, of the inside of a blank for a shallow, easy to assemble container, including steam vents.

Referring now to FIG. 4, a blank for producing a container according to a second embodiment of the instant invention is indicated generally at 130. The blank comprises a bottom panel 132, a top panel 134 and a rear wall 136 hingedly connecting the bottom and top panels 132 and 134 along lower and upper fold lines 138 and 140. A front wall 142 is connected to the front edge, defined by fold line 144, of the bottom panel 132. A flap 146, hingedly connected to the front wall 142 along a fold line 148, is slit at 150 to receive a portion of a closure flap 152 which is hingedly connected to the top panel along fold line 154 and includes a fold line 156. A tab 158 is exposed when the flap 152 is folded along the fold line 156. The tab 158 is adapted to engage a cut-out 160 which is exposed when the flap 146 is folded along the fold line 148. This is discussed in more detail in connection with FIG. 6.

Inner side walls 164 are connected to and extend from the bottom panel 132 along fold lines 166 and 168, respectively. Front, inner, diagonal wall structures 170 and 172 are connected to the bottom panel 132 and the side walls 162 and 164, respectively. Rear, inner diagonal wall structures 174 and 176 are connected to the bottom panel 132, the side walls 162 and 164, respectively, and set-up panels 178 and 180, respectively. Outer side walls 182 and 184 are connected to and extend from the top panel 134 along fold lines 186 and 188, respectively. Front, outer, diagonal wall structures 190 and 192 are connected to the top panel 134 and the side walls 182 and 184, respectively. Rear, outer diagonal wall structures 194 and 196 are connected to the top panel 134, the side walls 182 and 184, respectively, and set-up panels 178 and 180, respectively. The blank 130 is symmetrical about its longitudinal axis so side wall 182 corresponds with side walls 184, diagonal wall structure 174 corresponds with diagonal wall structure 176, etc. Accordingly, the following description of the elements in the upper half of FIG. 4 will apply as well to the corresponding elements in the bottom half of FIG. 4.

Set-up panel 178 is connected to one end of the rear wall 136 along fold line 198. Set-up panel 178 is also connected to an outer rear coupling panel 200 along fold line 202, and an inner rear coupling panel 204 along fold line 206. Outer rear coupling panel 200 is, in turn, connected along fold line 208 to an outer rear diagonal wall panel 210 and these elements together constitute the outer rear diagonal wall structure 194. The outer rear coupling panel 200 is connected along fold line 212 to the top panel 134 and the outer rear diagonal wall panel 210 is connected along fold line 214 to the outer side wall 182.

Similarly, inner rear coupling panel 204 is connected along a fold line 216 to an inner rear diagonal wall panel 218 and these elements together constitute the inner rear diagonal wall structure 174. The inner rear coupling panel 204 is connected along fold line 220 to the bottom panel 132 and the inner rear diagonal wall panel 218 is connected along fold line 222 to the inner side wall 162.

Figure 5:
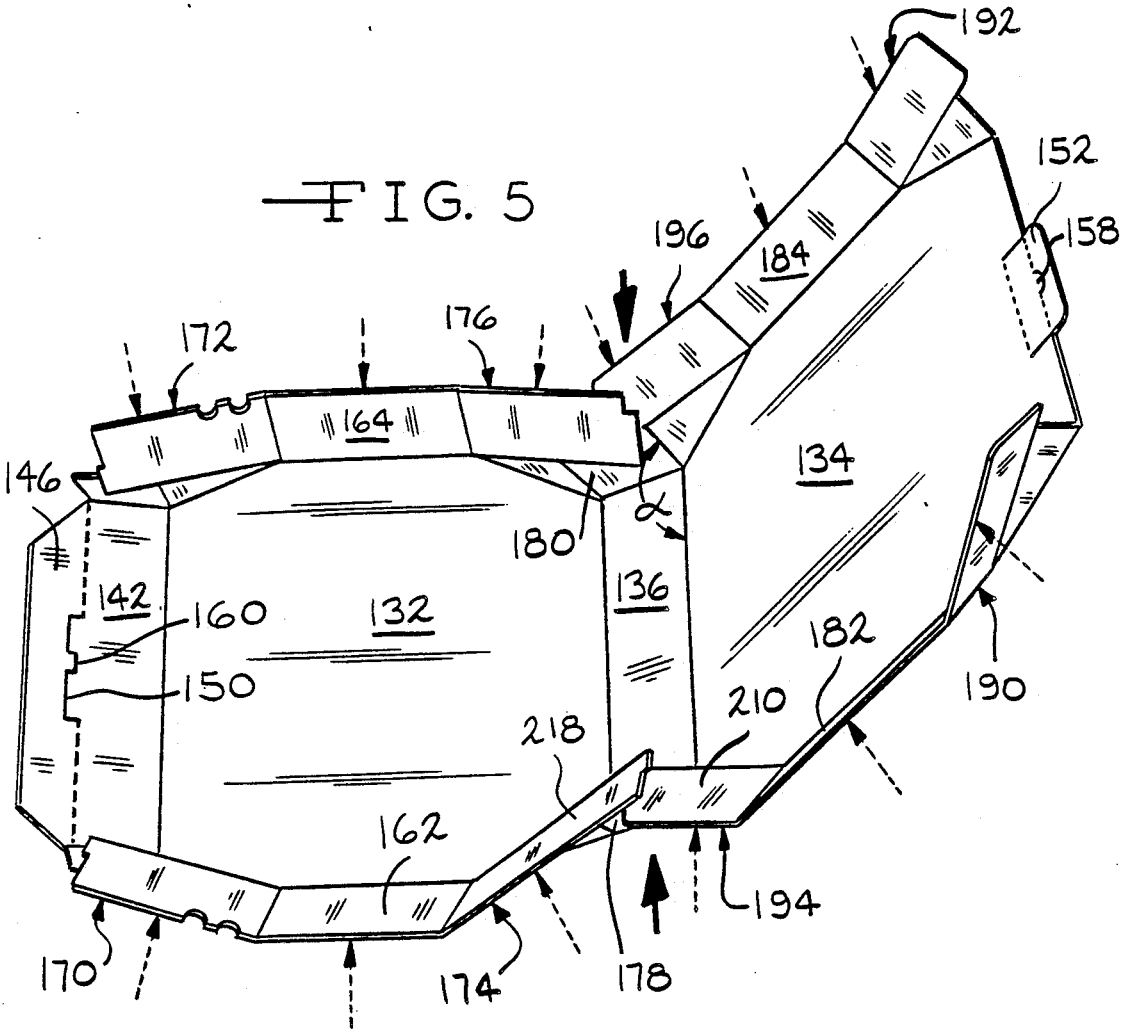
FIG. 5 is a perspective view of the blank shown in FIG. 4, during set-up.
Figure 6:
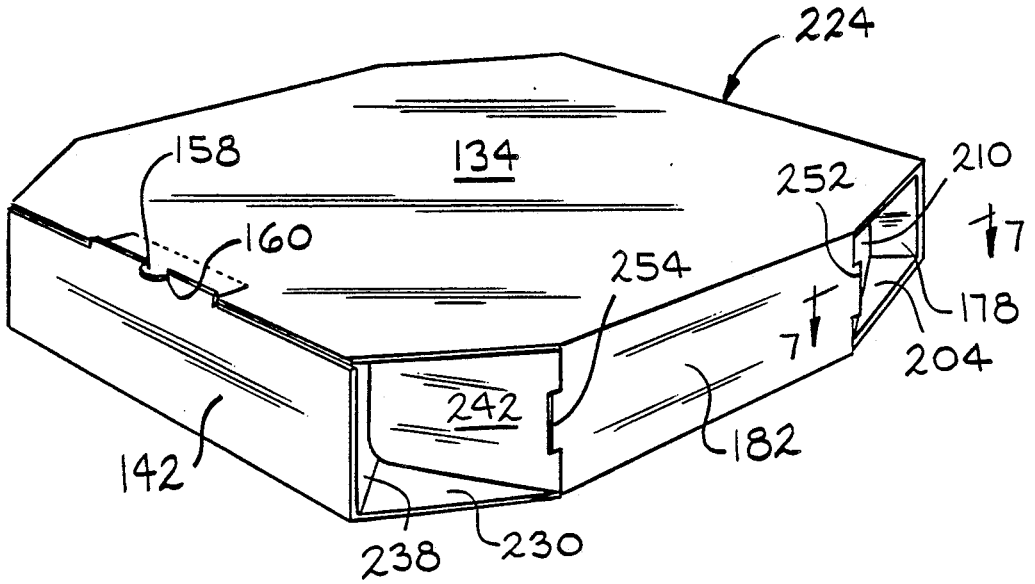
FIG. 6 is a perspective view of a fully closed container set-up from the blank shown in FIGS. 4 and 5.

The illustrated blank 130 is self erecting in the sense that, the action of folding or pivoting the set-up panel 178 upwardly about the fold line 198 and similarly folding the set-up panel 180 about the fold line corresponding with 198 (this is represented in FIG. 5 by bold arrows), assuming a condition where the bottom is anchored, for example, by the weight of a payload (not shown) resting on the bottom panel 132, will create the reactions represented in FIG. 5 by arrows with dotted tails. The initiation of the reactions represented in FIG. 5 can be facilitated by combining inward and upward pressure on the set-up panels 178 and 180 with a slight lifting force exerted on the top panel 134. Once the reactions begin, however, the lifting force is not required to sustain the reactions represented by the arrows with dotted tails. Continued pressure on the set-up panels 178 and 180 in the direction of the bold arrows will sustain the reactions. When the set-up has progressed a little beyond the point illustrated in FIG. 5, an angle $\alpha$ between the rear wall 136 and the set-up panel 180, and a corresponding angle between the rear wall 136 and the set-up panel 178, will be less than 90°. At that point, rapid and sure closure of the blank can be effected by squeezing together the set-up panel 180 and the rear wall 136 on the one side and the set-up panel 178 and the rear wall 136 on the other side. This squeezing action can be utilized to bring the diagonal wall structures 190 and 192 down around the diagonal wall structures 170 and 172 at which time the closure means can be utilized to fasten closed the erected container 224 as shown in FIG. 6. In this embodiment, fastening is effected by inserting the closure flap 152 through the slit 150 and engaging the tab 158 in the cut-out 160. Other means for fastening the container 224 in a closed position can be utilized, of course, and one example of other fastening means will be discussed below in connection with FIGS. 10 and 11. Other fastening means will be discussed below with reference to FIGS. 12–16. First, additional features of the blank 130 will be discussed with reference to FIGS. 4, 5 and 6.

The top panel 134 and associated elements are sized, relative to the bottom panel 132 and associated elements so that, during the set-up described above in connection with FIGS. 5 and 6, the outer side walls 182 and 184 are guided by the reactions to be outside of the inner side walls 162 and 164 in the set-up container 224. So too are the outer, rear diagonal wall panel 210 and the corresponding outer, rear diagonal wall panel guided to be outside of the inner, rear diagonal wall panel 218 and the corresponding inner rear diagonal wall panel, in the set-up container 224. Specifically, the top panel 134 is sized to be slightly larger than the bottom panel 132 and the inner rear coupling panel 204 is slightly longer along the fold line 216 than is the outer rear coupling panel 200 along the fold line 208. In addition, there are several offsets between adjacent fold lines and these are circled. The amount of offset in each case is between approximately one sixteenth (1/16) and one eighth ($\frac{1}{8}$) of an inch. The amount of offset in a particular location is not critical, nor is the amount by which the top panel 134 and the coupling panel 204 are larger than bottom panel 132 and coupling panel 200, so long as they are controlled to produce the reactions described above in connection with FIG. 5.

Referring again to FIG. 4, the inner diagonal wall structure 170 of the blank 130 comprises an inner front diagonal panel 226 connected to and extending from the inner side wall 162 along a fold line 228. The diagonal panel 226 is also connected to an inner coupling panel 230 along a fold line 232. The coupling panel 230 is also connected, along a fold line 234, to the bottom panel 132, and is connected, along a fold line 236, to a reverse, inner, diagonal wall panel 238. The wall panel 238 is connected, along a fold line 240, to the front wall 142. The front, outer diagonal wall structure 190 comprises a front, outer diagonal wall panel which is connected along a fold line 244 to the outer side wall 182, and is connected, along a fold line 246, to a front, outer coupling panel 248. The coupling panel is also connected, along a fold line 250, to the top panel 134. The set-up described above in connection with FIG. 5 creates reactions in the components of the top and bottom front diagonal wall structures and the reactions are represented in FIG. 5 by arrows with dotted tails.

Figure 7:
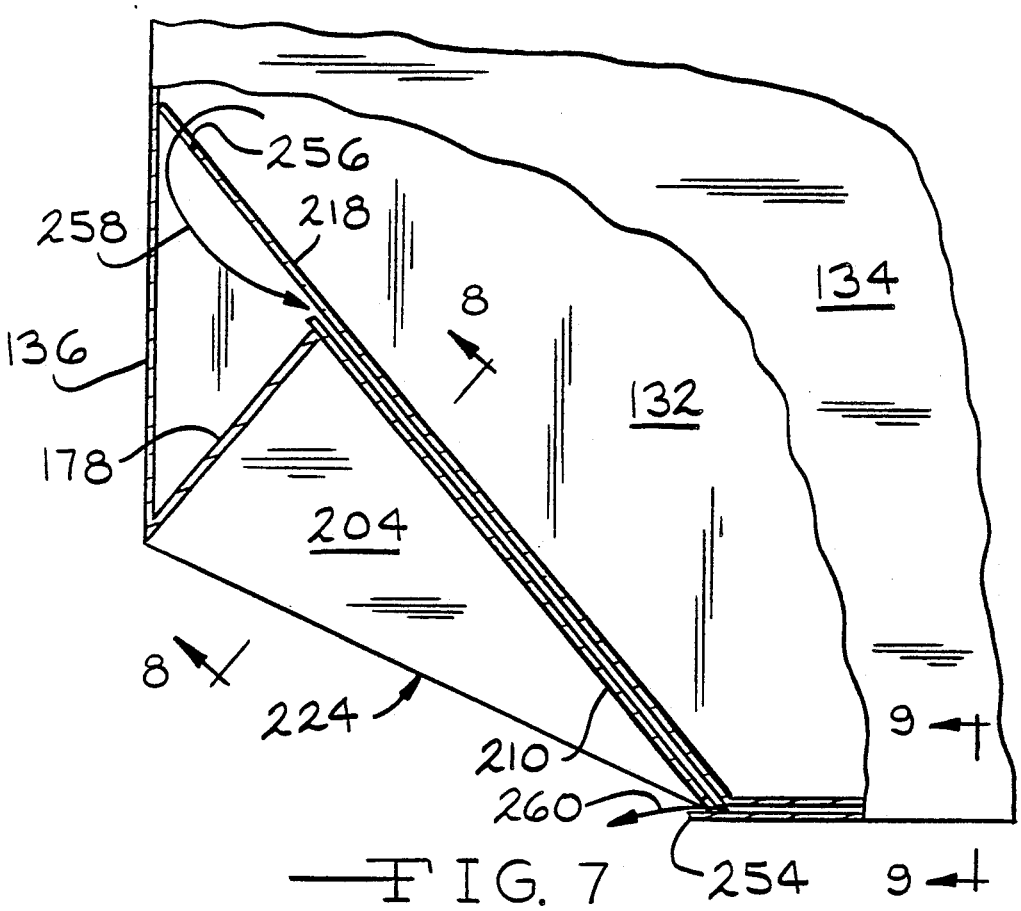
FIG. 7 is a sectional view taken along the line 7—7 of FIG. 6.
Figure 8:
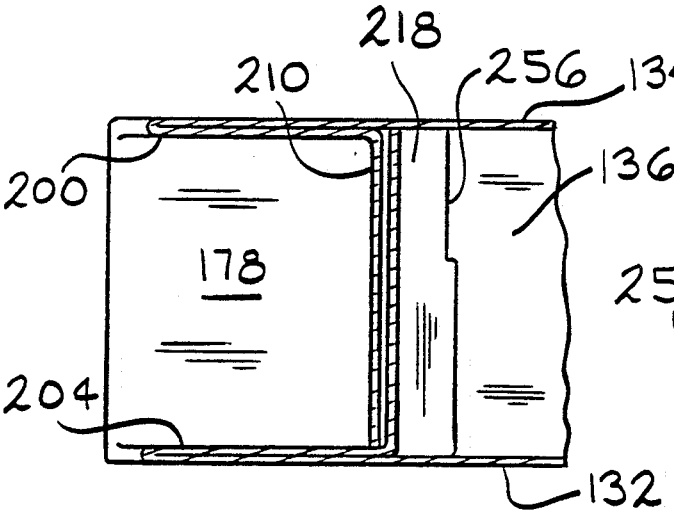
FIG. 8 is a sectional view taken along the line 8—8 of FIG. 7.
Figure 9:
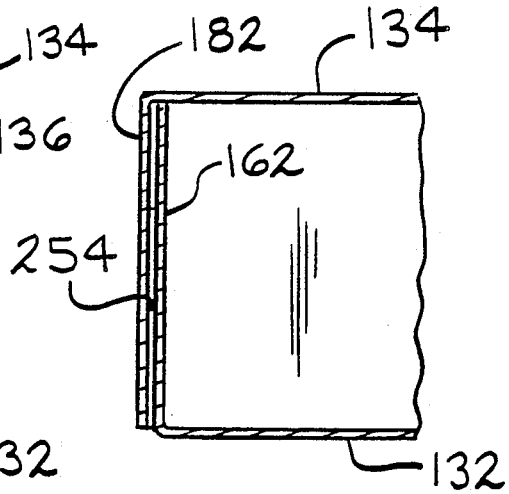
FIG. 9 is a sectional view taken along the line 9—9 of FIG. 8.

At opposite ends of the outer side wall 182, there are provided vent slots 252 and 254. One or both of the vent slots 252 and 254 may be provided to allow hot moist air to escape from between the outer, front diagonal wall panel 242 and the inner, front diagonal wall panel 226. Hot moist air is vented from the inside of the container 224 through an opening defined the rear wall 136 and a cut out 256 provided on the inner, rear diagonal panel 218. This relationship is better illustrated in FIG. 7 where the flow of hot moist air out of the inside of the container 224 is represented by an arrow 258. The hot, moist air is vented to the atmosphere by passing between the panels 210 and 218 and escaping, as represented by an arrow 260, through the vent slot 254. This flow of air between the panels 210 and 218 will transfer heat to and raise the temperature of the outside of panel 218, consequently reducing the rate at which heat is transferred through the panel 218. Thus, the illustrated vent arrangement uses hot moist air to transfer heat to the panel 218 and thereby reduce the rate at which heat is lost from inside the container 224. Similarly, vents 262 will vent hot, moist air from inside the container 224 to flow between the panels 226 and 242 and out from between these panels through the vent slot 252.

Figure 10:
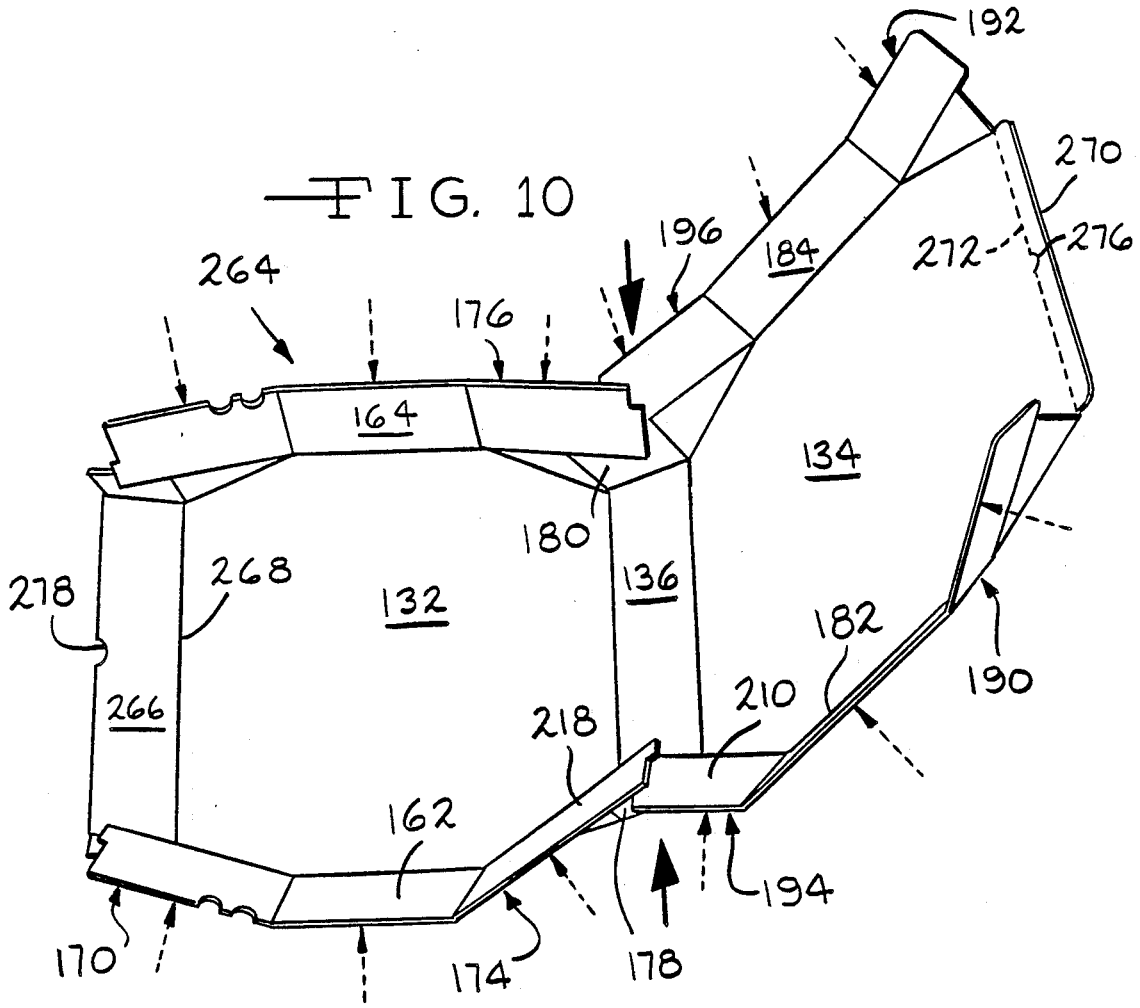
FIG. 10 is a perspective view of a blank, during set-up, which blank is similar to the blank illustrated in FIG. 5.
Figure 11:
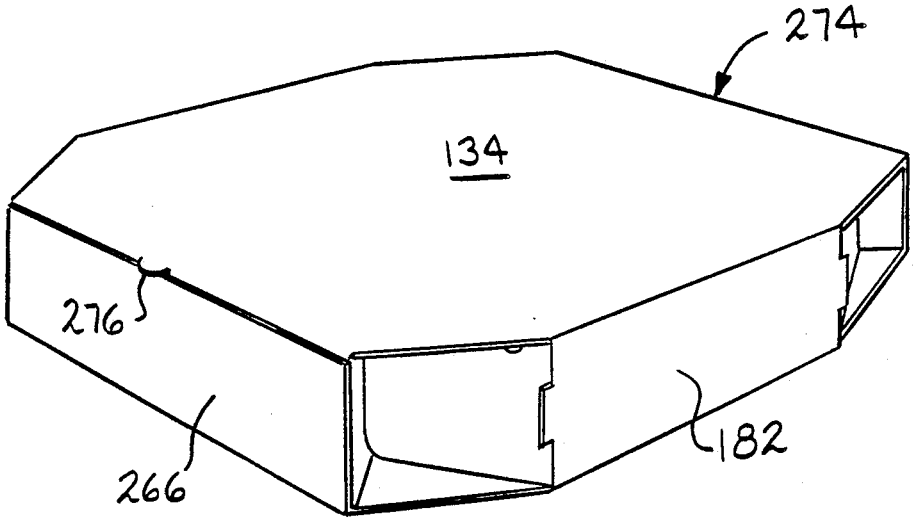
FIG. 11 is a perspective view of a fully closed container set-up from the blank shown in FIG. 10.

FIGS. 10 and 11 illustrate a blank 264 corresponding with the blank 130 except for the details of construction of the means for fastening the blank 264 in a closed position. Specifically, a front wall 266 is connected, along a fold line 268, to the bottom panel 132. A closure flap 270 is connected to the top panel 134 along a fold line 272. The flap is received between the front wall 266 and the reverse, front diagonal panel 238, on one side and the corresponding reverse, front diagonal panel on the other side, thereby fastening the container 274 closed. Additional fastening is provided by a tongue 276 which is received in a cut-out 278.

Figure 12:
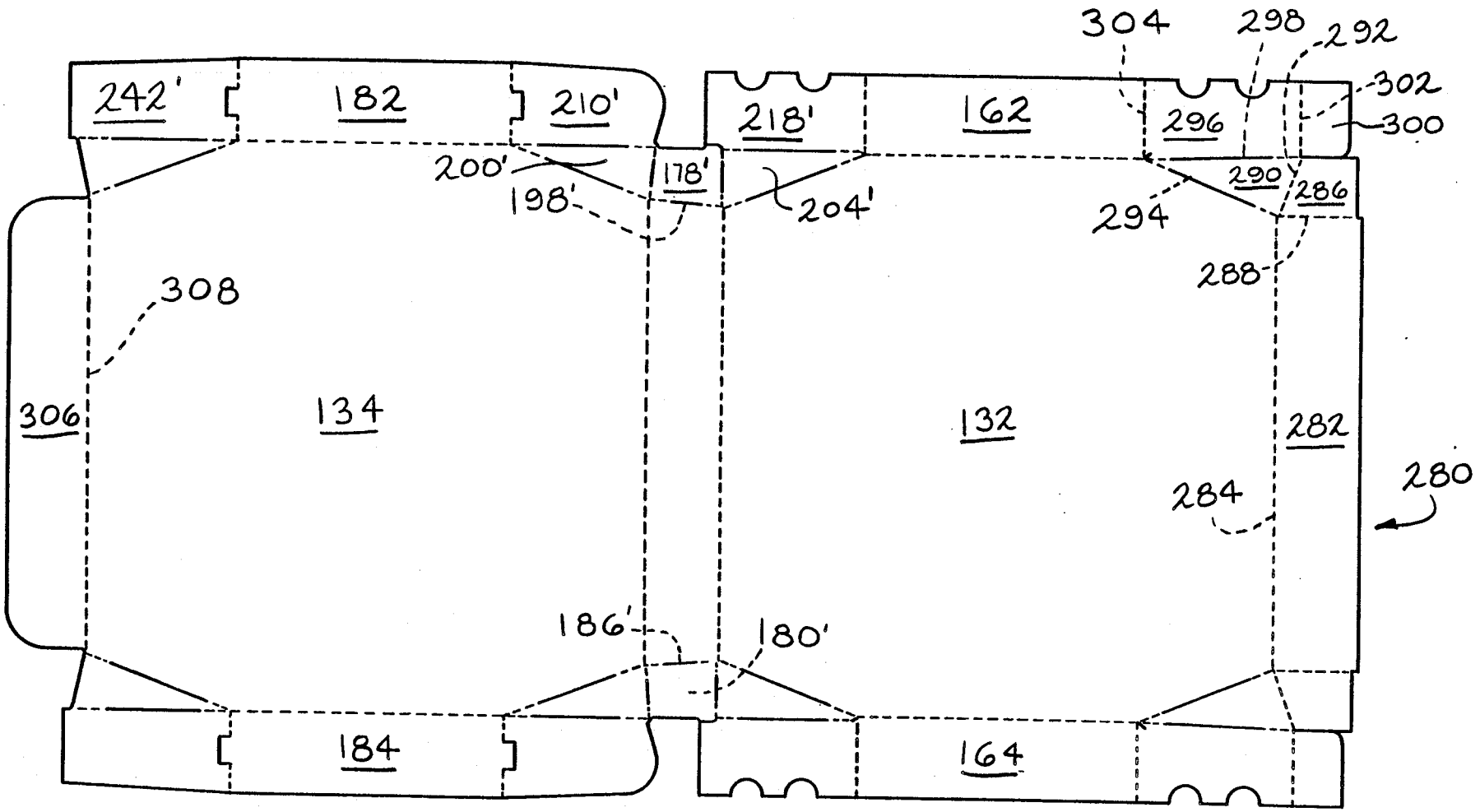
FIG. 12 is a plan view, drawn to scale, of the inside of a blank for a shallow container, which blank is similar to the blank shown in FIGS. 4, but includes improved front panel closure means.

Referring now to FIG. 12, a blank 280 corresponds generally with blanks 130 and 264, but has an entirely different arrangement for fastening closed a box produced from the blank 280. The blank also includes improved front corner structures. A front wall 282 is hingedly connected to bottom panel 132 along a fold line 284. The front wall is also hingedly connected to a locking reverse front diagonal panel 286 along a fold line 288. The panel 286 is also hingedly connected to a coupling panel 290 along a fold line 292. The coupling panel 290, in turn, is hingedly connected to the bottom panel 132 along fold line 294 and also to a front diagonal panel 296 along a fold line 298. A locking tab 300 is hingedly connected to the front diagonal panel 296 along a fold line 302. The front diagonal panel 296 is also hingedly connected to side wall 162 along a fold line 304. A closure flap 306 is hingedly connected to top panel 134 along a fold line 308.

There are some additional differences between the blank 280 and the blanks 130 and 264. Some of these other differences are differences of form, where the function of the element in the blank 280 is the same as or similar to the function of a corresponding element in the blanks 130 and 264. Some of the elements of the blank 280 which differ in form from those corresponding elements of the blanks 130 and 264 are identified by the corresponding element's reference numeral followed by a prime mark. Thus, the blank 280 includes an outer rear diagonal panel 210' which has a different shape than the outer rear panel 210 in the blanks 130 and 264, but nonetheless functions like the panel 210, as described in connection with FIGS. 4 through 11.

Figure 13:
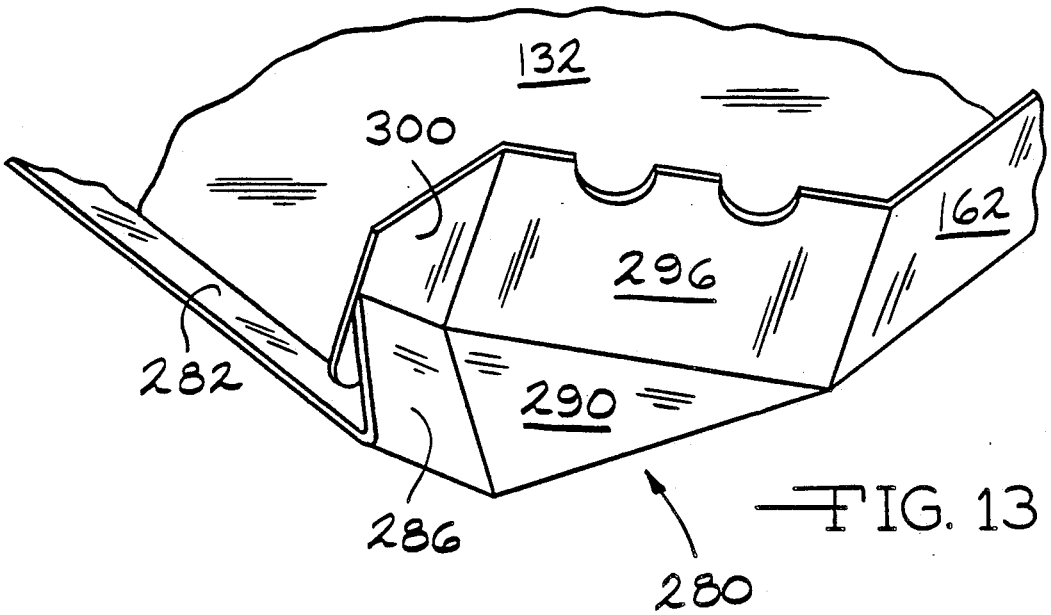
FIG. 13 is a perspective view of a portion of the blank shown in FIG. 12, during initial engagement of front locking tabs.
Figure 14:
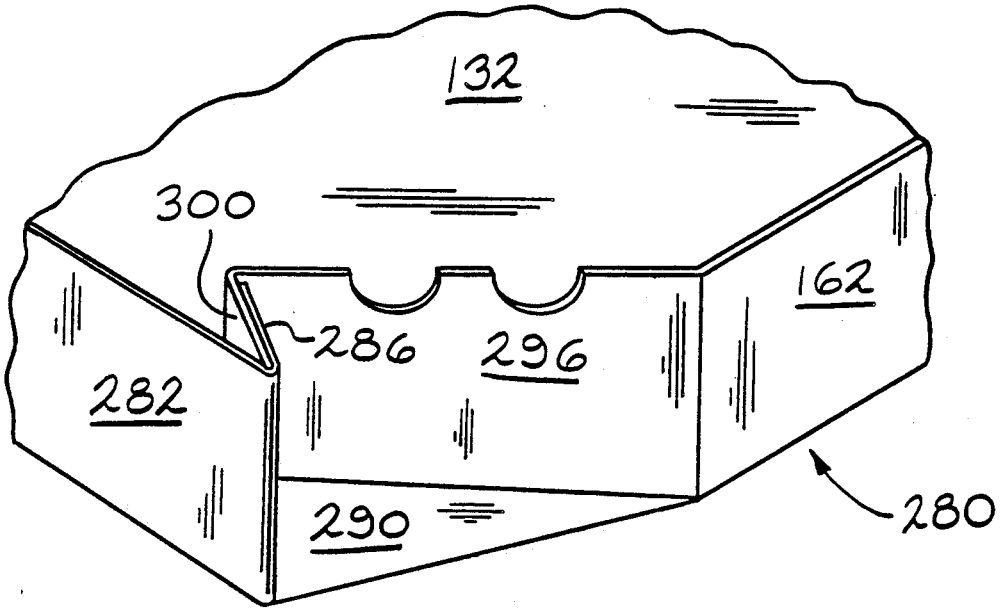
FIG. 14 is a perspective view of the portion of the blank shown in FIG. 13 after engagement of a corner locking tab.

The blank 280 is set-up, initially, by folding the front panel 282 upwardly and folding the reverse front diagonal panel 286 and the coupling panel 290 inwardly, as illustrated in FIG. 13. As set-up continues, the locking tab 300 is manually turned outwardly so as to position it between the reverse front diagonal panel 286 and the front panel 282. At least a portion of the locking tab 300 extends all the way to the intersection of the front panel 282 and the reverse diagonal panel 286, as shown in FIG. 14. It will be appreciated that the same set-up procedure would be applied to the panels and tabs at the end of the front panel 282 opposite from the one illustrated in FIGS. 13 and 14, to produce the arrangement illustrated on the left side of FIG. 15. The locking tabs 300 give the front panel 282, the reverse front diagonal panels 286, the diagonal panels 296 and the side walls 162 and 164 remarkable support so that they can retain the relative positions illustrated for them in FIG. 15.

Figure 15:
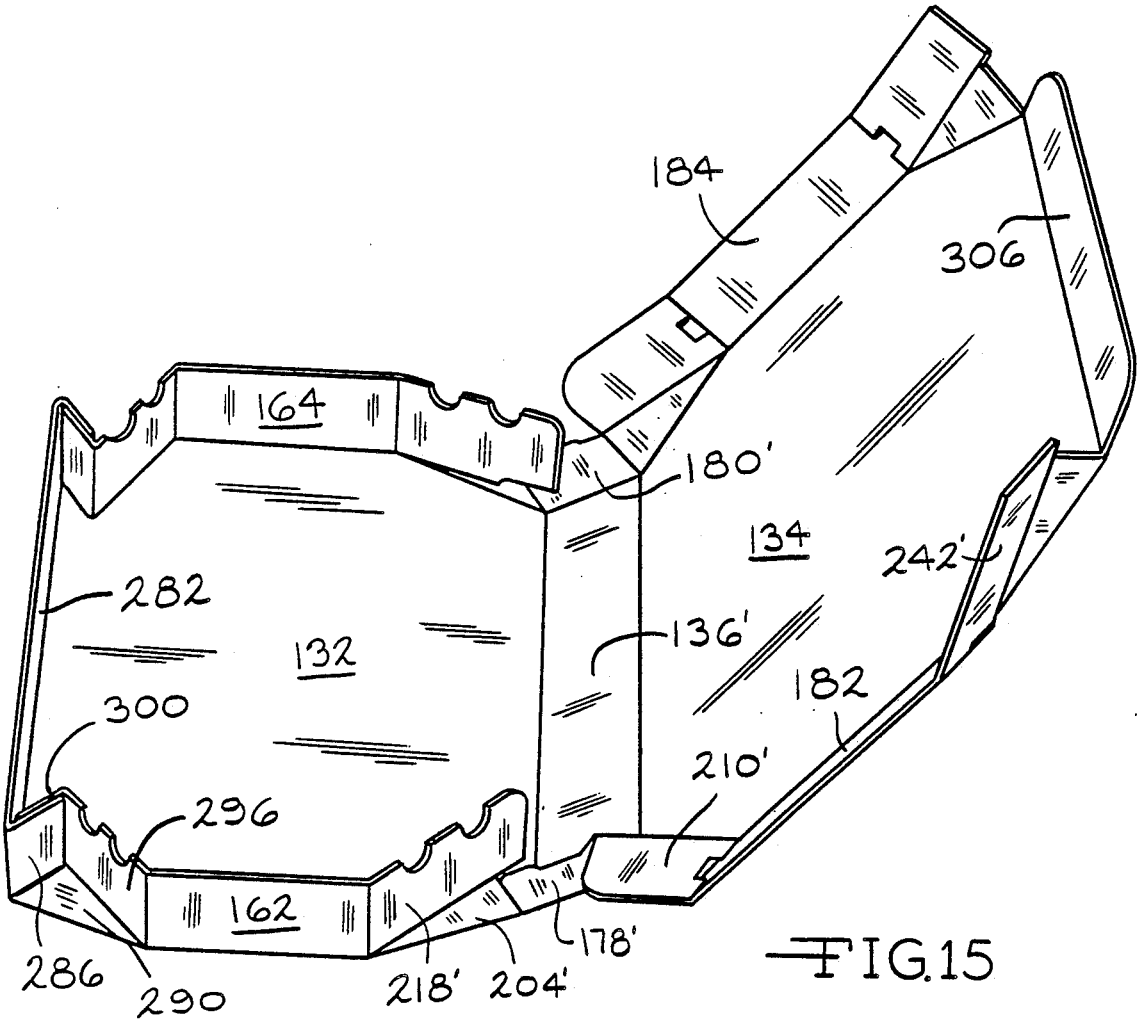
FIG. 15 is a perspective view of the FIG. 12 blank after the front has been set-up and set-up of the rest of the container has begun.
Figure 16:
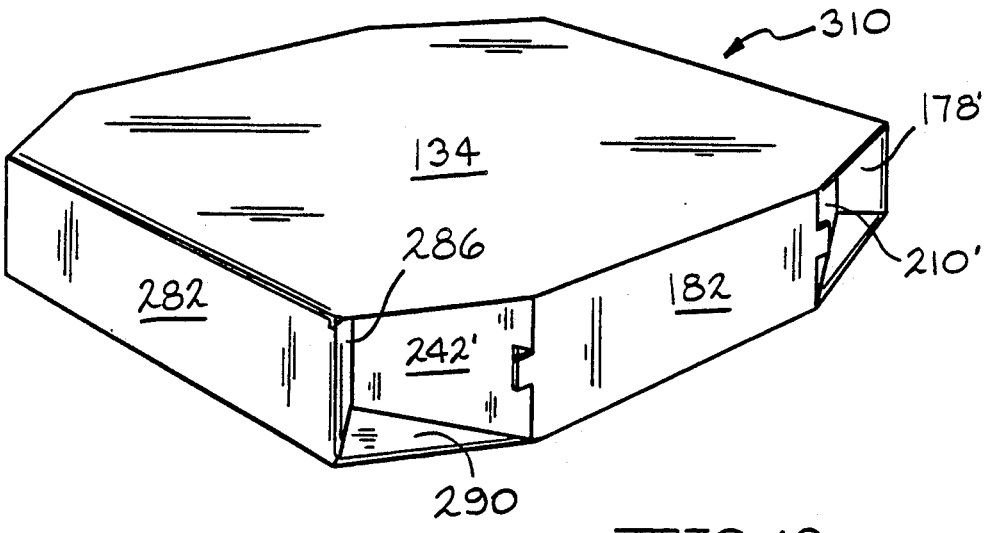
FIG. 16 is a perspective view of the container blank shown in FIGS. 12–15, in a fully assembled and closed condition.

With further reference to FIG. 15, set-up has proceeded as the set-up panels 178' and 180' have been folded inwardly and the top panel 134 has been lifted. From this stage of set-up, the top panel 134 is pivoted about the rear wall 136' to a nearly closed position and the closure flap 306 is inserted between the front wall 282 and the locking tab 300 to produce a closed container 310 as shown in FIG. 16. The width of the flap 306 is controlled so that it will be frictionally engaged between the front wall 282 and the locking tab 300.

Figure 17:
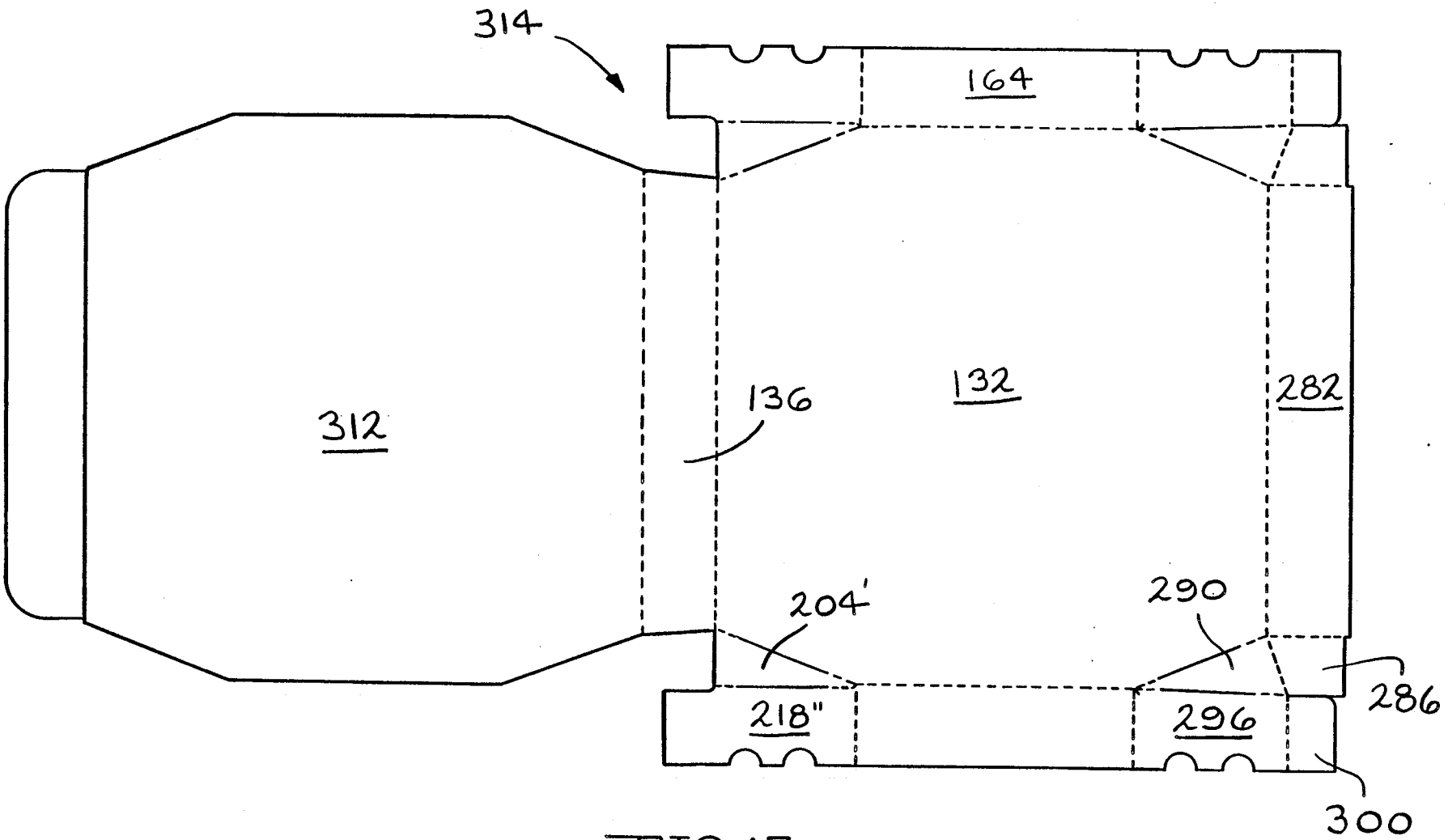
FIG. 17 is a plan view of a blank with a bottom similar to the blank shown in FIG. 12, and a simple top.

It will be appreciated that a variety of top panel configurations can be substituted for the configuration of the top panel 134. A suitable top 312 is illustrated in FIG. 17 in association with a blank 314 for producing a single side wall container. Other than the top 312 and the lack of set-up panels, the blank 314 corresponds with the blank 280. The closure flap 306 is connected to the top 312 and is receivable between the front panel 282 and the locking tabs 300. Frictional engagement of the closure flap 306 between the front panel 282 and the locking tab 300 will give a container set-up from the blank 314 excellent rigidity and strength. It is to be noted that rear diagonal side walls 218" are longer than corresponding diagonal side walls 218' and 218 so that the rear diagonal side walls 218" will extend to the rear wall 136 in a container set-up from the blank 314. Alternatively, the rear diagonal side walls 218" could be the same length as the rear diagonal side walls 218' and 218, if set up panels (not shown) corresponding with set-up panels 178 and 180 or 178' and 180' were provided on the blank 314.

Figure 18:
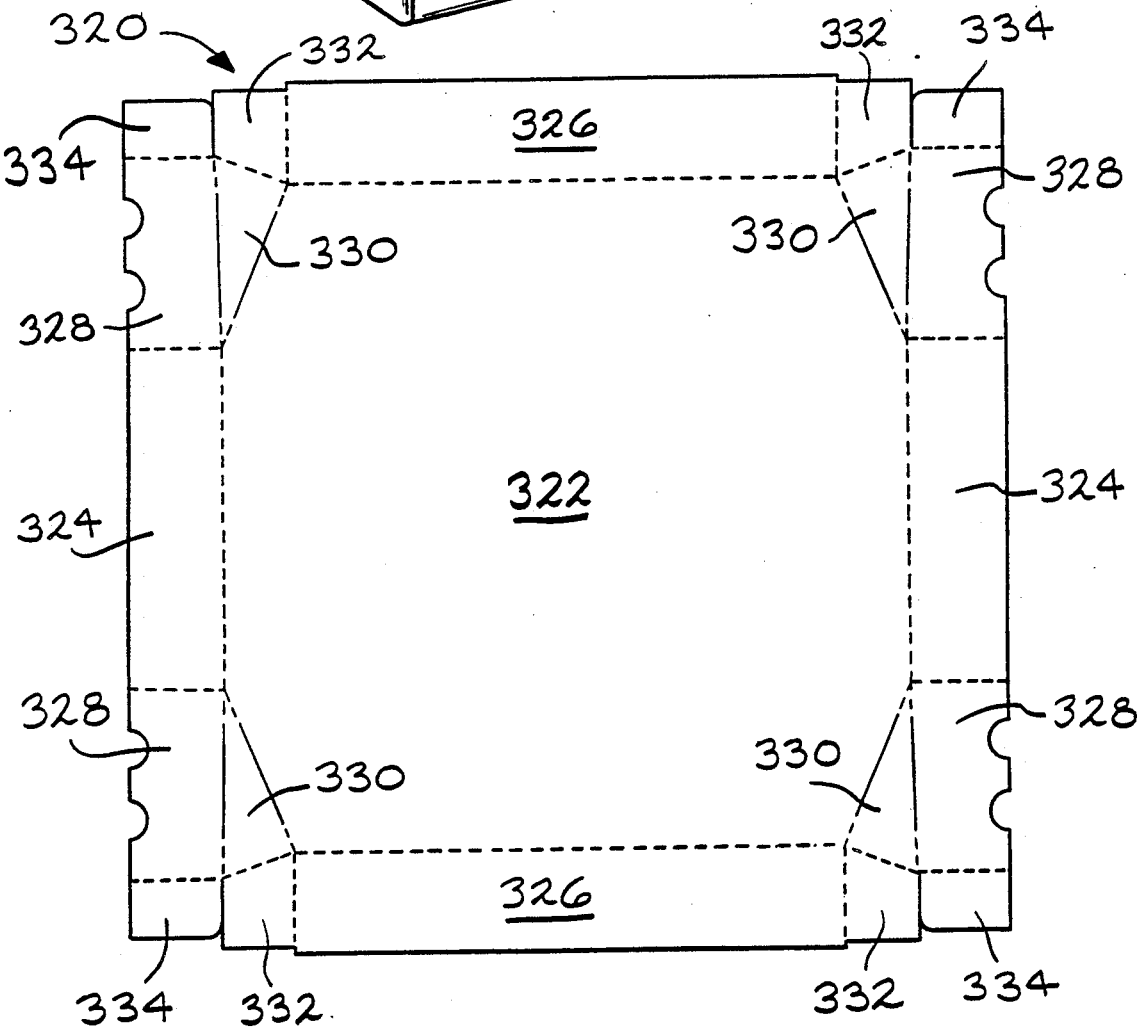
FIG. 18 is plan view of a blank, drawn to scale, for producing a tray with corners including locking tabs.

Referring now to FIG. 18, a blank for producing a topless container or tray is indicated generally at 320. The blank comprises a bottom panel 322, a pair of opposed side walls 324 connected to the bottom panel 322, and two opposed end walls 326 connected to the bottom panel 322. Four diagonal side wall panels 328 are provided, one being connected to each end of each side wall 324. The diagonal side wall panels 328 are also connected to coupling panels 330 which are connected, in turn, to the bottom panel 322. To each end of each end wall 326, there is connected a reverse diagonal side wall 332 which, in turn, is connected to the adjacent coupling panel 330. Finally, a locking tab 334 is connected to each of the diagonal side wall panels 328, opposite the connection thereof to the side walls 324.

Set-up of the blank 320 is carried out by manipulating the end walls 326 and the associated structures, substantially as described above for the front wall 282 and associated structures, with reference to FIGS. 13 and 14. Specifically, the end walls 326 are folded upwardly as the adjacent reverse diagonal side walls 332 and the coupling panels 330 are folded upwardly and inwardly. As set-up progresses, the locking tab 334 is inserted between the adjacent end wall 326 and reverse diagonal side wall 332.

If desired, a simple top (not shown) can be hingedly connected to one of the side walls 324 or one of the end walls 326. It would be preferred to connect a top to one of the end walls 326 so that a portion of such a top can be received between the opposed end wall 326 and the adjacent locking tabs 334.

Figure 19:
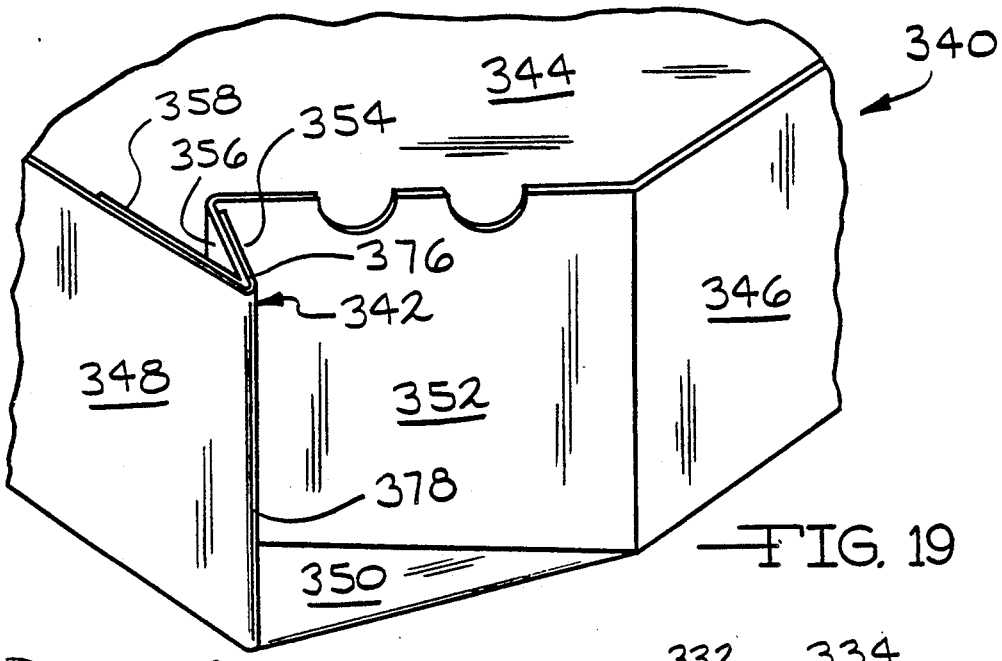
FIG. 19 is a perspective view of a corner structure including a locking tab and a reverse locking tab.

Referring now to FIG 19, a portion of a container, indicated generally at 340, includes a corner structure, indicated generally at 342, with a modified locking tab arrangement. The container 340 comprises a bottom panel 344, side wall 346 and front or end wall 348. A coupling panel 350 is connected to the bottom panel 344 and is also connected to a diagonal side wall panel 352 and a reverse diagonal side wall panel 354. The diagonal side wall panel 352 is connected to the side wall 346 and the reverse diagonal side wall panel 354 is connected to the front or end wall 348. A first locking tab 356 is connected to and extends from the diagonal side wall panel 352. A second locking tab 358 is connected to and extends from the first locking tab 356. The first locking tab 356 extends from the diagonal side wall panel 352 a distance corresponding with the width of the reverse diagonal side wall panel 354. The first locking tab 356 and the second locking tab 358 extend from the diagonal side wall panel a combined distance corresponding approximately with the depth of the side wall 346 and the front or end wall 348. Accordingly, from the standpoint of reducing scrap in producing blanks, the double locking tab configuration is well suited to relatively deep containers while the single tab configuration is well suited to relatively shallow containers. Additionally, more rigidity and corner strength is usually desirable in deeper containers and the double locking tab configuration provides such rigidity and corner strength.

Figure 20:
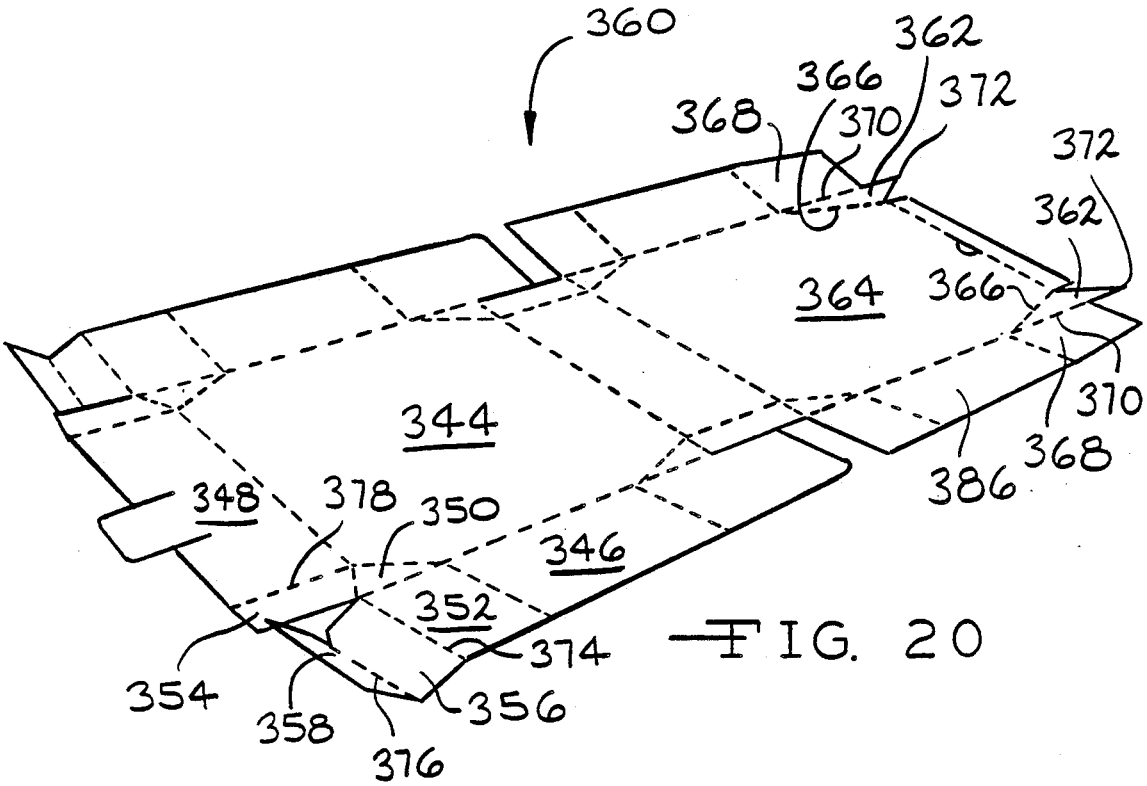
FIG. 20 is a perspective view of a container blank for producing a deep, double walled container including corner structures of the type illustrated in FIG. 19.

A blank for producing a container including the corner structure 340 is indicated generally at 360 in FIG. 20. The blank 360 corresponds in many ways with the blank 280 illustrated in FIG. 12. One difference resides in front outer coupling panels 362 which are connected to a top panel 364 along score lines 366. The coupling panels 362 are also connected to outer, front diagonal wall panels 368 along score lines 370. The coupling panels include tab means 372 which function in a manner which is described below with reference to FIG. 21.

Assembly of the blank 360 begins with "breaking" the blank 360 along score lines 374 which separate the first and second locking tabs 356 and 358, and also along score lines 376 which separate the inner side walls 346 and the first locking tabs 356, as shown in FIG. 20. The second locking tabs 358 are folded against the first locking tabs 356 and, together, they are folded upwardly and inwardly towards the center of the blank 360. This causes a reaction through the coupling panels 350 which in turn causes the front wall 348 to fold upwardly and causes the reverse diagonal side wall panel 354 to fold over towards the front wall 348. The first and second locking tabs are then positioned between the front wall 348 and the reverse diagonal side wall panel 354, thereby aligning the score line 376 with a score line 378 which separates the front wall 348 from the reverse diagonal side wall panel 354, substantially as shown in FIG. 19. Set-up of the blank 360 proceeds in the manner described above for blank 280 with reference to FIG. 15.

Figure 21:
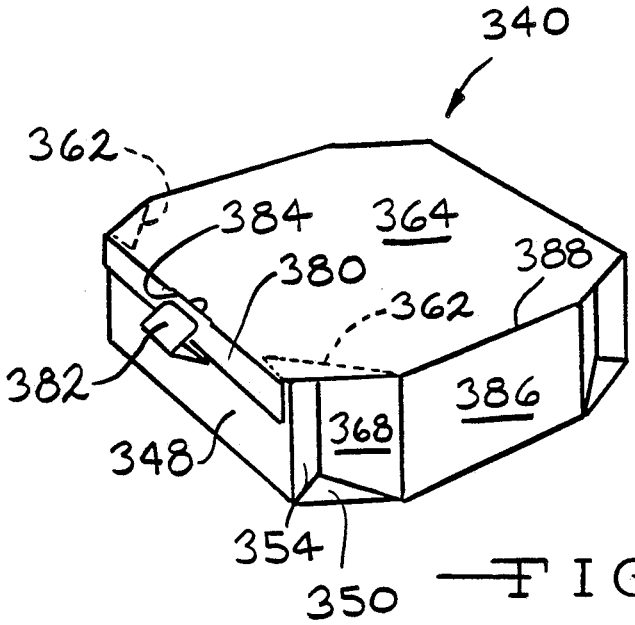
FIG. 21 is a perspective view of a container produced from the blank illustrated in FIG. 21.

Referring now to FIG. 21, the container set-up from the blank 360 is indicated generally at 340. A closure flap 380 is positioned adjacent to and outside the front wall 348. A locking closure tab 383 depends from the front wall 348 and is positioned to be inserted in a slot, indicated at 384, formed between the closure flap 380 and the top panel 364. When received in the slot indicated at 384, the locking closure tab 382 maintains the top panel in a closed position, as illustrated in FIG. 21.

With the container 340 in the closed position illustrated in FIG. 21, the tab means 370 of the coupling panels 362 are locked between upper edges of the reverse diagonal side wall panel 354 and the first locking tabs 356, on the one hand, and the top panel 364, on the other hand. This locked condition prevents outer side walls 386 from being deflected outwardly and pivoting about score lines 388 which separate the side walls 386 from the top panel 364. Specifically, with the tab means 370 held captive, outward deflection of the adjacent outer, front diagonal wall panels 368 is resisted because the tab means 370 and the outer, front diagonal wall panels 368 are both connected to the coupling panels 362. The outer side walls 386 are in turn connected to the outer, front diagonal wall panels 368. Accordingly, if one grasped the outer side walls 386 and picked up the closed container 340 illustrated in FIG. 21, the side walls 386 would be positively maintained in the positions illustrated for them, even if there was a substantial payload in the container 340.

It will be appreciated that the container 340 can be provided with vents such as those discussed above, particularly with reference to FIGS. 5–9, to channel warm air from inside the container and between side walls to reduce the rate at which heat is transferred from inside the container. Similarly, the container 340 can be provided with one or more insulative layers in accordance with the features discussed above in connection with FIGS. 1–4.

Figure 22:
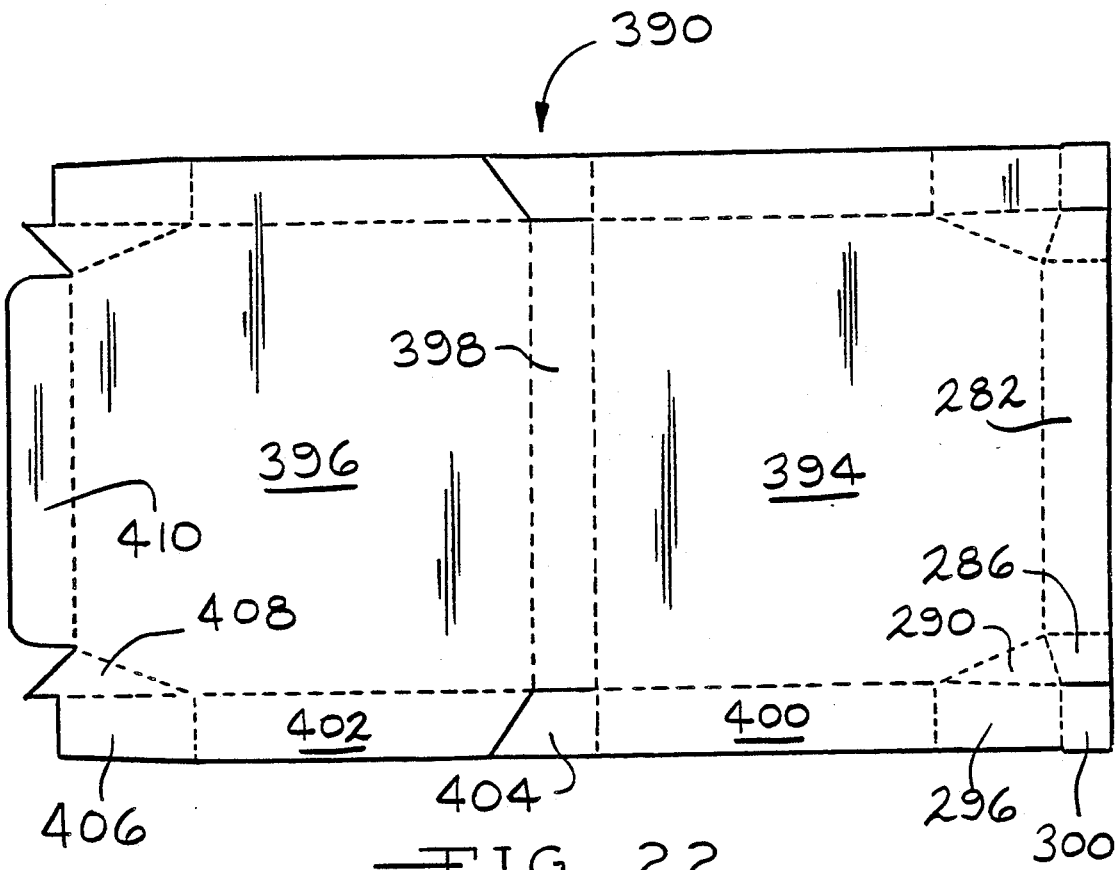
FIG. 22 is a plan view of an integral prescored blank for producing a six-sided container with front corner structures including locking tabs.
Figure 23:
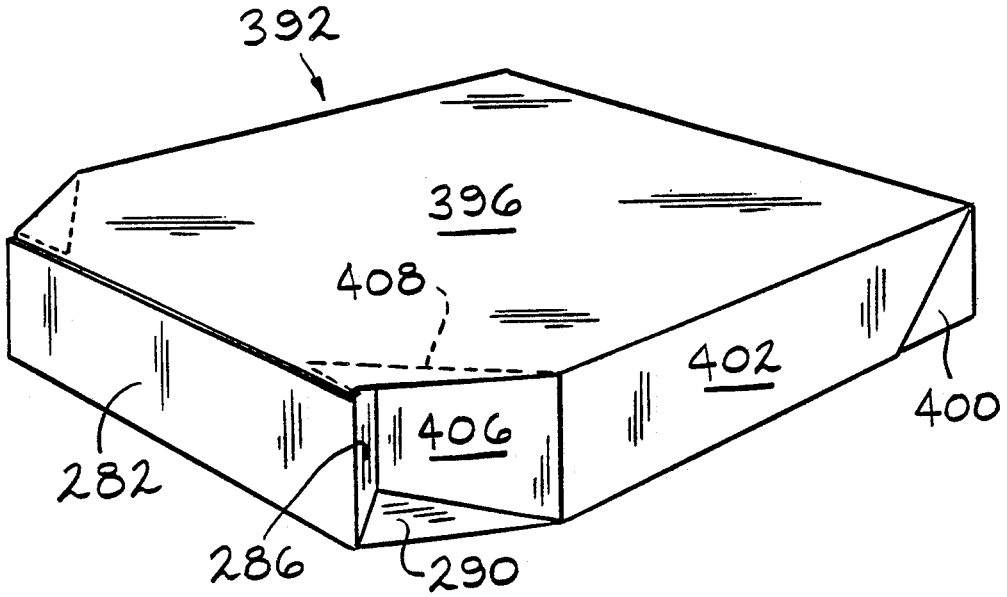
FIG. 23 is a perspective view of a six sided container produced from a blank corresponding with the one illustrated in FIG. 22.

Referring now to FIGS. 22 and 23, a blank for producing a six-sided container is indicated generally at 390 in FIG. 22 and a six-sided container produced therefrom is indicated generally at 392 in FIG. 23. The blank 390 is cut and scored to define a bottom panel 394, a top panel 396 and a rear or hinged wall 398 hingedly connecting the top and bottom panels 396 and 394. Inner side walls 400 are connected to and extend from the bottom panel 394 and outer side walls 402 are connected to and extend from the top panel 396. The blank 390 includes front corner structures similar to those discussed above, particularly in connection with FIGS. 12–15, and like reference numerals have been applied to corresponding elements. Specifically, the blank 390 includes a front wall 282 hingedly connected to the bottom panel 394. The front wall 282 is also hingedly connected to a locking reverse front diagonal panel 286. The panel 286 is hingedly connected to a coupling panel 290. The coupling panel 290, in turn, is hingedly connected to the bottom panel 394 and also to a front diagonal panel 296. A locking tab 300 is hingedly connected to the front diagonal panel 296. The front corner structures in the blank 390 are set-up in the manner illustrated in FIGS. 13 and 14.

Reinforcing tabs 404 are connected to and extend from the inner side walls 400. The tabs 404 are disconnected from the rear wall 398 and from the outer side walls 402. After the front corner structures are set-up, the reinforcing tabs 404 are folded inwardly. Outer, front diagonal wall panels 406, which are connected to the outer side walls 402 and to coupling panels 408, are folded over so that each of the coupling panels is adjacent to the top panel 396. At this stage, the top panel is folded over and a 368 and a closure flap 410, which is connected to and extends from the top panel 396, is inserted between the front wall 282 and the locking tab 300 where it is frictionally engaged. The set-up box 392 is illustrated in FIG. 23. The coupling panels 408, shown in hidden lines in FIG. 23 are held captive between the locking tab 300 and the locking reverse front diagonal panel 286, on the one hand, and the top panel 396 on the other hand.

One distinct benefit obtained with blanks 280 (FIG. 12), 314 (FIG. 17), 360 (FIG. 20) and 390 (FIG. 22) is significantly reduced material usage and, therefore, cost. The height of the front wall or panel 282 (FIGS. 12, 17 and 22) and the height of the front wall 348 (FIG. 20) are less than half of the height of the front panel 70 (FIG. 2) of blank 50. Consequently, a box produced from blanks corresponding with blanks 280 (FIG. 12), 314 (FIG. 17), 360 (FIG. 20) and 390 (FIG. 22) will require less material than the same size box if it was produced from a blank corresponding with blank 50 (FIG. 2). Nonetheless, the corner structures in the blanks 280 (FIG. 12), 314 (FIG. 17), 360 (FIG. 20) and 390 (FIG. 22) produce boxes with exceptional strength and rigidity in the front wall or panel 282 (FIGS. 12, 17 and 22) and the front wall 348 (FIG. 20), despite the fact that such front walls are a single thickness as compared with the double thickness of the front wall produced from the front panel 70 in the blank 50 (FIG. 2).

The foregoing detailed description is intended to enable one skilled in this art to practice the invention, rather than to limit the invention. Modifications may occur to those skilled in the art, but fall, nonetheless, within the spirit and scope of the following claims.

I claim:

1. A container formed from a unitary, prescored blank, said container comprising:

a bottom panel a first side wall connected to and depending from said bottom panel, said first side wall having first and second ends, second and third opposed side walls connected to and depending from said bottom panel, said second and third side walls having first and second ends, first and second diagonal side wall panels having first and second ends, said first ends being connected to said first ends of said second and third side walls, first and second coupling panels connecting each of said first and second front diagonal side wall panels to said bottom panel, first and second reverse, front diagonal side wall panels connecting said first and second ends of said first side wall to said first and second coupling panels, and a pair of first locking tabs connected to and depending from said second ends of said first and second diagonal side wall panels, said locking tabs being receivable between said reverse, front diagonal side wall panels and said first side wall.

2. The container claimed in claim 1 which further comprises a top panel and a closure flap connected thereto, wherein said closure flap is sized to be received between said first pair of locking tabs and said front side wall and frictionally retained there.

3. The container claimed in claim 1 which further comprises a pair of second locking tabs connected to and depending from the first pair of locking tabs, opposite said first and second diagonal side wall panels, said pair of second locking tabs being positionable against said first side wall in face-to-face relation therewith.

4. The container claimed in claim 3 which further comprises a top panel and a closure flap connected thereto, wherein said closure flap is sized to be received between said pair of first locking tabs and said pair of second locking tabs and frictionally retained there.

5. A container formed from a unitary, prescored blank, said container comprising:

a bottom panel first and second opposed side walls connected to and depending from said bottom panel, said first and second side walls having first and second ends, third and fourth opposed side walls connected to and depending from said bottom panel, said third and fourth side walls having first and second ends, first and second pairs of diagonal side wall panels having first and second ends, said first ends of said first pair being connected to said first ends of said third and fourth side walls, said first ends of said second pair being connected to said second ends of said third and fourth side walls, first and second pairs of coupling panels connecting said first and second pairs front diagonal wall panels, respectively, to said bottom panel, first and second pairs of reverse, front diagonal side wall panels, said first pair being connected to said first and second ends of said first side wall and to said first pair of coupling panels, said second pair being connected to said first and second ends of said second side wall and to said second pair of coupling panels, and first and second pairs of first locking tabs, said first pair being connected to and depending from said second ends of said first pair of diagonal side wall panels, said second pair being connected to said second ends of said second pair of diagonal side wall panels, said locking tabs being receivable between said reverse, front diagonal side wall panels and said first and second side walls.

6. The container claimed in claim 5 which further comprises a top panel and a closure flap connected thereto, wherein said closure flap is sized to be received between said first or second pair of locking tabs and said first or second side wall and frictionally retained there.

7. The container claimed in claim 5 which further comprises first and second pairs of second locking tabs connected to and depending from the first and second pairs of locking tabs, opposite said first and second pairs of diagonal side wall panels, said first and second pairs of second locking tabs being positionable against said first and second side walls, respectively, in face-to-face relation therewith.

8. The container claimed in claim 7 which further comprises a top panel and a closure flap connected thereto, wherein said closure flap is sized to be received between said first or second pair of first locking tabs and said first or second pair of second locking tabs and frictionally retained there.

9. A container formed from a unitary, prescored blank, said container comprising:

a bottom panel, a first side wall connected to and depending from said bottom panel, said first side wall having first and second ends, second and third opposed side walls connected to and depending from said bottom panel, said second and third side walls having first and second ends, a fourth side wall connected to and depending from said bottom panel, said fourth side wall having first and second ends, a top panel connected to said fourth side wall, first and second pairs of diagonal side wall panels having first and second ends, said first ends of said first pair being connected to said first ends of said second and third side walls, said first ends of said second pair being connected to said second ends of said second and third side walls, first and second pairs of coupling panels connecting said first and second pairs of diagonal side wall panels to said bottom panel, first and second reverse, front diagonal side wall panels connecting said first and second ends of said first side wall to said first pair of coupling panels, and a pair of first locking tabs connected to and depending from said second ends of said first pair of diagonal side wall panels, said locking tabs being receivable between said reverse, front diagonal side wall panels and said first side wall.

10. The container claimed in claim 9 which further comprises a closure flap connected to said top panel, wherein said closure flap is sized to be received between said pair of first locking tabs and said first side wall and frictionally retained there.

11. The container claimed in claim 9 which further comprises a pair of second locking tabs connected to and depending from said pair of first locking tabs, opposite said first pair of diagonal side wall panels, said pair of second locking tabs being positionable against said first side wall in face-to-face relation therewith.

12. The container claimed in claim 11 which further comprises a closure flap connected to said top panel, wherein said closure flap is sized to be received between said pair of first locking tabs and said pair of second locking tabs and frictionally retained there.

13. A container formed from a unitary, prescored blank and comprising:

a bottom panel a top panel, a first side wall hingedly connecting said top and bottom panels, said side wall having first and second ends, second and third outer side walls connected to and depending from one of said bottom and top panels, said outer side walls having first and second ends, second and third inner side walls connected to and depending from the other of said bottom and top panels, said inner side walls having first and second ends, at least one fourth side wall connected to and depending from one of said top and bottom panels, said fourth side wall having first and second ends, first and second pairs of inner and outer rear diagonal side wall panels connected to said first ends of said second inner and outer side walls and said first ends of said third inner and outer side walls, respectively, first and second pairs of inner and outer coupling panels connecting each of said first and second pairs of inner and outer rear diagonal wall panels to said top and bottom panels, first and second set-up panels connected, respectively, to said first and second ends of said first side wall, said first and second set-up panels also being connected, respectively, to said first and second pairs of inner and outer coupling panels, first and second pairs of inner and outer front diagonal side wall panels having first and second ends, said first ends being connected to said second ends of said second inner and outer side walls and said second ends of said third inner and outer side walls, third and fourth pairs of inner and outer coupling panels connecting each of said first and second pairs of inner and outer front diagonal wall panels to said top and bottom panels, first and second reverse, front diagonal side wall panels connecting said first and second ends of said fourth side wall to one of said third pair and one of said fourth pair of inner and outer coupling panels, and a pair of first locking tabs connected to and depending from the second end of those front diagonal side wall panels which are connected to the coupling panels to which said reverse, front diagonal side wall panels are connected, said locking tabs being receivable between said reverse, front diagonal side wall panels and said fourth side wall.

14. The container claimed in claim 13 which further comprises a closure flap connected to said top panel, wherein said closure flap is sized to be received between said pair of first locking tabs and said fourth side wall and frictionally retained there.

15. The container claimed in claim 13 which further comprises a pair of second locking tabs connected to and depending from said pair of first locking tabs, opposite said diagonal side wall panels, said pair of second locking tabs being positionable against said fourth side wall in face-to-face relation therewith.

16. The container claimed in claim 15 which further comprises a closure flap connected to said top panel, wherein said closure flap is sized to be received between said pair of first locking tabs and said pair of second locking tabs and frictionally retained there.

17. A container formed from a unitary, prescored blank, said container comprising:

a bottom panel, a top panel, a first side wall hingedly connecting said bottom panel and said top panel, second and third opposed inner side walls connected to and depending from said bottom panel, said second and third inner side walls having first and second ends, second and third opposed outer side walls connected to and depending from said top panel, said second and third outer side walls having first and second ends, a fourth side wall connected to said bottom panel, said fourth side wall having first and second ends, first and second inner diagonal side wall panels having first and second ends, said first ends being connected to said first ends of said second and third inner side walls, first and second outer diagonal side wall panels having first and second ends, said first ends being connected to said first ends of said second and third outer side walls, first and second inner coupling panels connecting each of said first and second inner front diagonal side wall panels to said bottom panel, first and second outer coupling panels connecting each of said first and second outer front diagonal side wall panels to said top panel, first and second reverse, front diagonal side wall panels connecting said first and second ends of said first side wall to said first and second inner coupling panels, and a pair of first locking tabs connected to and depending from said second ends of said first and second inner diagonal side wall panels, said locking tabs being receivable between said reverse, front diagonal side wall panels and said fourth side wall.

18. The container claimed in claim 17 which further comprises reinforcing tabs connected to and depending from said second ends od said second and third inner side wall.

19. The container claimed in claim 17 which further comprises a closure flap connected to said top panel, wherein said closure flap is sized to be received between said pair of first locking tabs and said fourth side wall and frictionally retained there.

20. The container claimed in claim 18 which further comprises a closure flap connected to said top panel, wherein said closure flap is sized to be received between said pair of first locking tabs and said fourth side wall and frictionally retained there.

21. The container claimed in claim 17 which further comprises a pair of second locking tabs connected to and depending from said pair of first locking tabs, opposite said first and second inner diagonal side wall panels, said pair of second locking tabs being positionable against said fourth side wall in face-to-face relation therewith.

22. The container claimed in claim 18 which further comprises a pair of second locking tabs connected to and depending from said pair of first locking tabs, opposite said first and second inner diagonal side wall panels, said pair of second locking tabs being positionable against said fourth side wall in face-to-face relation therewith.

23. The container claimed in claim 21 which further comprises a closure flap connected to said top panel, wherein said closure flap is sized to be received between said pair of first locking tabs and said pair of second locking tabs and frictionally retained there.

24. The container claimed in claim 22 which further comprises a closure flap connected to said top panel, wherein said closure flap is sized to be received between said pair of first locking tabs and said pair of second locking tabs and frictionally retained there.

25. The container claimed in claim 13, 14, 15 or 16 wherein said third and fourth outer coupling panels are provided with tab means for engagement between opposed portions of the container to provide additional structural integrity.

26. The container claimed in claim 17, 18, 19, 20, 21, 22, 23 or 24 wherein said first and second outer coupling panels are provided with tab means for engagement between opposed portions of the container to provide additional structural integrity.

27. A container formed from a unitary, prescored blank and comprising:

a bottom panel a top panel, a first side wall hingedly connecting said top and bottom panels, said side wall having first and second ends, second and third outer side walls connected to and depending from said top panel, said outer side walls having first and second ends, second and third inner side walls connected to and depending from said bottom panel, said inner side walls having first and second ends, at least one fourth side wall connected to and depending from said bottom panel, said fourth side wall having first and second ends, first and second pairs of inner and outer rear diagonal side wall panels connected to said first ends of said second inner and outer side walls and said first ends of said third inner and outer side walls, respectively, first and second pairs of inner and outer coupling panels connecting each of said first and second pairs of inner and outer rear diagonal wall panels to said top and bottom panels, first and second set-up panels connected, respectively, to said first and second ends of said first side wall, said first and second set-up panels also being connected, respectively, to said first and second pairs of inner and outer coupling panels, first and second pairs of inner and outer front diagonal side wall panels having first and second ends, said first ends being connected to said second ends of said second inner and outer side walls and said second ends of said third inner and outer side walls, third and fourth pairs of inner and outer coupling panels connecting each of said first and second pairs of inner and outer front diagonal wall panels to said top and bottom panels, first and second reverse, front diagonal side wall panels connecting said first and second ends of said fourth side wall to said third and said fourth inner coupling panels, and a pair of first locking tabs connected to and depending from the second end of said third and fourth inner front diagonal side wall panels, said locking tabs being receivable between said reverse, front diagonal side wall panels and said fourth side wall.

28. The container claimed in claim 27 which further comprises a closure flap connected to said top panel, wherein said closure flap is sized to be received between said pair of first locking tabs and said fourth side wall and frictionally retained there.

29. The container claimed in claim 27 which further comprises a pair of second locking tabs connected to and depending from said pair of first locking tabs, opposite said diagonal side wall panels, said pair of second locking tabs being positionable against said fourth side wall in face-to-face relation therewith.

30. The container claimed in claim 29 which further comprises a closure flap connected to said top panel, wherein said closure flap is sized to be received between said pair of first locking tabs and said pair of second locking tabs and frictionally retained there.

31. The container claimed in claim 27, 28, 29 or 30 wherein said third and fourth outer coupling panels are provided with tab means for engagement between opposed portions of the container to provide additional structural integrity.

32. A shallow container formed from a unitary, prescored blank and comprising:

a bottom panel a top panel, a first side wall hingedly connecting said top and bottom panels, said side wall having first and second ends, second and third side walls connected to and depending from one of said bottom and top panels, a fourth side wall connected to and depending from one of said top and bottom panels and closure means connected thereto for selectively maintaining said top panel in a closed position, a first pair of interior diagonal side wall panels connected to said second and third side walls, each of said diagonal side wall panels being positioned opposite one of said first or fourth side wall and defining therewith a channel and vent means for allowing warm air to flow from the inside of the container, into and through each of said channels and out from said channels at a point remote from where the warm air flows into said channels, so as to warm said diagonal side wall panels and thereby to reduce the rate at which heat is transferred through said first pair of diagonal side wall panels from the interior of the container.

33. The container claimed in claim 32 which additionally includes a second pair of diagonal side wall panels connected to said second and third side walls, each of said second pair of diagonal side wall panels being positioned opposite the other one of said first or fourth side wall and defining therewith a channel and vents means for allowing warm air to flow from the inside of the container, and wherein said vent means allow warm air to flow through said channels defined between said first and second pairs of diagonal side wall panels and said first and fourth side walls.

* * * * *